US010072421B2

(12) United States Patent
Griffin et al.

(10) Patent No.: US 10,072,421 B2
(45) Date of Patent: Sep. 11, 2018

(54) PRE-FABRICATED DOMED SKYLIGHT SYSTEM

(71) Applicant: NUCOR CORPORATION, Charlotte, NC (US)

(72) Inventors: Todd Harmon Griffin, Eufaula, AL (US); Dickson Richard Scot Macon, Fort Wayne, IN (US); Dean Lee Harlamert, Eufaula, AL (US)

(73) Assignee: NUCOR CORPORATION, Charlotte, NC (US)

( * ) Notice: Subject to any disclaimer, the term of this patent is extended or adjusted under 35 U.S.C. 154(b) by 0 days.

(21) Appl. No.: 14/862,842

(22) Filed: Sep. 23, 2015

(65) Prior Publication Data

US 2016/0083963 A1 Mar. 24, 2016

Related U.S. Application Data

(60) Provisional application No. 62/054,625, filed on Sep. 24, 2014.

(51) Int. Cl.
*E04D 13/03* (2006.01)
*E04D 3/28* (2006.01)
*E04D 3/30* (2006.01)

(52) U.S. Cl.
CPC ..... *E04D 13/0305* (2013.01); *E04D 13/0315* (2013.01); *E04D 3/30* (2013.01)

(58) Field of Classification Search
CPC . E04D 13/0305; E04D 13/0315; E04D 13/03; E04D 3/28; E04D 3/30; Y10S 52/17
(Continued)

(56) References Cited

U.S. PATENT DOCUMENTS 4,439,962 A * 4/1984 Jentoft ..... E04D 13/0305 49/DIG. 1
4,470,230 A * 9/1984 Weisner ..... E04D 13/0315 206/509

(Continued)

OTHER PUBLICATIONS

International Search Report and Written Opinion for International Patent Application No. PCT/US15/51725 dated Dec. 30, 2015.

(Continued)

*Primary Examiner* — Phi D A
*Assistant Examiner* — Omar F Hijaz
(74) *Attorney, Agent, or Firm* — Moore & Van Allen PLLC; Jeffrey R. Gray

(57) ABSTRACT

Embodiments of the present invention comprise pre-fabricated domed skylight panel assemblies for use within steel decking systems. The skylight within the pre-fabricated domed skylight panel assembly is domed. Extending from the width-wise ends of the domed portion are respective skylight end extension portions for overlapping with adjacent steel decking panels or for coupling within an aperture of a decking panel. Further, extending from the length-wise edges of the dome portion are skylight edges configured for connection to decking panel edges (e.g., male and female rail edges or panel edges) that are configured for connection to edges of adjacent decking panels. The pre-fabricated domed skylight panel assemblies provide the desired light into the building, structural support in the steel decking system, ease of shipping of the domed skylight panel assemblies, ease of installation of the domed skylight panel assemblies at the building site, and a water tight seal.

18 Claims, 33 Drawing Sheets

(58) Field of Classification Search
USPC ..... 52/200, 201; 82/200, 201
See application file for complete search history.

(56) References Cited

U.S. PATENT DOCUMENTS

| | | | | |
|---|---|---|---|---|
| 4,514,944 | A * | 5/1985 | Doell | E04D 13/0305 52/200 |
| 4,559,753 | A * | 12/1985 | Brueske | E04D 13/031 52/200 |
| 4,825,608 | A * | 5/1989 | Makin | E04D 13/03 52/200 |
| 4,860,511 | A * | 8/1989 | Weisner | E04D 3/28 52/200 |
| 5,092,089 | A * | 3/1992 | Kessler | E04D 13/0305 49/489.1 |
| 5,323,576 | A * | 6/1994 | Gumpert | E04D 3/34 52/200 |
| 5,896,711 | A | 4/1999 | McClure | |
| 6,151,838 | A * | 11/2000 | Husein | E04D 13/1475 52/200 |
| 6,532,877 | B1 * | 3/2003 | Hepburn | E04D 13/0305 105/355 |
| 7,395,636 | B2 | 7/2008 | Blomberg | |
| 7,712,279 | B2 | 5/2010 | McClure | |
| 7,937,900 | B1 | 5/2011 | Gaffney et al. | |
| 8,061,092 | B2 | 11/2011 | McClure | |
| 8,397,468 | B2 | 3/2013 | McClure | |
| 8,713,864 | B1 | 5/2014 | Smith, Jr. | |
| 8,833,010 | B1 * | 9/2014 | Schlabach | E04D 13/03 52/200 |
| 9,316,000 | B2 * | 4/2016 | Pendley | E04D 13/031 |
| 2004/0049996 | A1 * | 3/2004 | Blomberg | E04D 13/03 52/200 |
| 2006/0191230 | A1 * | 8/2006 | Gumpert | E04D 3/28 52/519 |
| 2008/0190050 | A1 * | 8/2008 | McClure | E04D 3/28 52/200 |
| 2012/0233942 | A1 * | 9/2012 | McLain | E04D 13/0315 52/200 |
| 2015/0013248 | A1 * | 1/2015 | Pendley | E04D 3/352 52/200 |

OTHER PUBLICATIONS

International Preliminary Report on Patentability for International Patent Application No. PCT/US15/51725 dated Mar. 28, 2017.

* cited by examiner

PRE-FABRICATED DOMED SKYLIGHT SYSTEM

CLAIM OF PRIORITY UNDER 35 U.S.C. § 119

The present Application for a Patent claims priority to U.S. Provisional Patent Application Ser. No. 62/054,625 entitled "Pre-Fabricated Domed Skylight System" filed on Sep. 24, 2014 and assigned to the assignees hereof and hereby expressly incorporated by reference herein.

FIELD

The present invention is related to the field of roof decking panels and roof decking systems, and more specifically domed skylight panel assemblies for use in roof decking systems.

BACKGROUND

Incorporating skylights into steel decking systems has proven difficult in achieving systems that allow for the desired amount of light during different times of the day.

SUMMARY OF THE EMBODIMENTS OF THE INVENTION

The following presents a simplified summary of one or more embodiments of the present invention, in order to provide a basic understanding of such embodiments. This summary is not an extensive overview of all contemplated embodiments, and is intended to neither identify key or critical elements of all embodiments nor delineate the scope of any or all embodiments. Its sole purpose is to present some concepts of one or more embodiments of the present invention in a simplified form as a prelude to the more detailed description that is presented later.

Embodiments of the invention comprise pre-fabricated domed skylight panel assemblies for use within steel roof decking systems. The pre-fabricated domed skylight panel assemblies provide the desired light into the building, structural support in the steel decking system, ease of shipping of the domed skylight panel assemblies, ease of installation of the domed skylight panel assemblies at the building site, and a water tight seal. The skylight within the pre-fabricated domed skylight panel assembly is domed and may comprise ribs that provide structural support within the domed skylight itself, and also structural support within the pre-fabricated domed skylight panel assemblies, and thus, within the steel decking systems.

Furthermore, because the skylight is domed, and because it may contain ribs, the domed skylight has more surface area than traditional flat skylights or other domed skylights of the same or similar size that do not have ribs. Moreover, in some embodiments the domed skylight may contain prismatic elements (e.g., projections that extend outwardly from, inwardly into, or between, one or more surfaces of the skylight), which act as a prism by capturing, directing, and/or reflecting the light into the building. As such, the domed skylight may capture more light when the sun is located in different locations within the sky than flat skylights that are not domed, do not have ribs, and/or do not have prismatic elements. As such, the domed skylight of the present invention may have a smaller footprint than flat skylights or other domed skylights, which allows the domed skylight of the present invention to be pre-fabricated in the size of a decking panel and still let in the same, similar, or increased amount of light than traditional flat or domed skylights with similar or greater footprints.

In addition, the domed skylight of the present invention is secured to decking panel rails or a cutout in a decking panel, with a water tight seal that may be pre-assembled under factory conditions instead of onsite. As such, the process of forming the pre-fabricated domed skylight panel assemblies is repeatable, making a more reliable water tight seal than typical in-field skylight installations. The pre-fabricated domed skylight panel assembly may be assembled by securing the domed skylight to the rails (e.g., edges of the male or female decking panel). The rails may be formed by rolling the rails into the desired male and female edges, or forming a steel decking panel and separating the rails from the trough (e.g., otherwise described as the pan) of the steel decking panels. Alternatively, the domed skylight may be assembled into a steel decking panel by forming an aperture in an existing decking panel and securing the domed skylight within the aperture of the existing panel. In this embodiment, the rails are integral with the decking panel.

Moreover, the pre-fabricated domed skylight panel assemblies can be stacked allowing shipping of multiple domed skylight panel assemblies at once in a reduced shipping volume.

The pre-fabricated domed skylight panel assemblies further provide ease of assembly on site since the pre-fabricated domed skylight panel assemblies have the same male and female edges as the other steel decking panels, and as such, can be assembled within a steel decking system in the same way as the steel decking panels are secured to each other (e.g., decking seaming tool, punch or crimping tool, side or top seam welding, or the like between male and female edges of adjacent decking panels). The pre-fabricated domed skylight assemblies may replace the standard decking panels at the locations in which skylights are desired within the steel decking system. As such, special skylight installation is not needed at the building site through installation of skylights into steel decking systems across multiple adjacent panels and seams of adjacent panels. The various embodiments of the invention are described in further detail below.

One embodiment of the invention is a pre-fabricated domed skylight panel assembly. The pre-fabricated domed skylight panel assembly comprises a domed skylight, comprising at least a domed portion; a male edge operatively coupled to the domed skylight; a female edge operatively coupled to the domed skylight; and wherein the pre-fabricated domed skylight panel assembly is configured for operative coupling with adjacent male and female edges on adjacent decking panels.

In further accord with embodiments of the invention, the male edge is a male rail edge and the female edge is a female rail edge; and wherein the male rail edge and the female rail edge are components of rail edge assemblies. The rail edge assemblies comprise sealant operatively coupled to a top surface of the domed skylight and a bottom surface of the male rail edge and the female rail edge; flashing operatively coupled to a bottom surface of the domed skylight; fasteners; and wherein the fasteners operatively couple the domed skylight to the male rail edge and the flashing, and to the female rail edge and the flashing.

In other embodiments of the invention, the domed skylight comprises a pane skylight portion operatively coupled to the domed skylight, wherein the pane skylight portion comprises a trough portion and two pane skylight edges extending from the trough portion, each operatively coupled to the male rail edge and the female rail edge and extending upwardly from the pane skylight portion.

In still other embodiments of the invention, the fasteners operatively couple the domed skylight to the male rail edge and the flashing, and to the female rail edge and the flashing at the pane skylight edges extending upwardly from the pane skylight portion.

In yet other embodiments of the invention, the pane skylight portion comprises two pane skylight ends extending from the domed portion to a length that defines a length of the pre-fabricated domed skylight panel assembly.

In further accord with embodiments of the invention, the male edge is a male panel edge and the female edge is a female panel edge; and wherein the male panel edge and the female panel edge are components in edge assemblies and formed from a decking panel with a decking panel aperture configured for receiving the domed skylight. Each panel edge assembly further comprises sealant operatively coupled to a top surface of the domed skylight and a bottom surface of the decking panel; flashing operatively coupled to a bottom surface of the domed skylight; fasteners; and wherein the fasteners operatively couple the domed skylight to the male panel edge and the flashing, and to the female panel edge and the flashing.

In other embodiments of the invention the domed skylight comprises a pane skylight portion operatively coupled to the domed skylight, wherein the pane skylight portion comprises a trough portion and two pane skylight edges extending from the trough portion, each operatively coupled to the male panel edge and the female panel edge and extending upwardly from the pane skylight portion.

In still other embodiments of the invention, the fasteners operatively couple the domed skylight to the male panel edge and the flashing, and to the female panel edge and the flashing at the trough portion.

In yet other embodiments of the invention, the fasteners operatively couple the domed skylight to the male panel edge and the flashing, and to the female panel edge and the flashing at the pane skylight edges extending upwardly from the pane skylight portion.

In further accord with embodiments of the invention, the pane skylight portion comprises two pane skylight ends extending from the trough portion to a length that is shorter than a length of the decking panel.

In other embodiments of the invention, the domed portion of the domed skylight is offset within the pre-fabricated dome skylight panel assembly such that a first length of one end of the pre-fabricated domed skylight panel assembly is longer than a second length of another end of the pre-fabricated domed skylight panel assembly to facilitate an overlapping coupling with adjacent decking panels in a decking panel system.

In still other embodiments of the invention, the domed portion comprises dome ribs extending outwardly from the domed skylight, and wherein adjacent dome ribs form a dome trough.

In yet other embodiments of the invention, the domed portion comprises dome ribs formed by domed troughs extending inwardly into the domed skylight, and wherein adjacent dome troughs form a dome rib.

In further accord with embodiments of the invention, the domed portion comprises a plurality of domed ribs, and wherein each of the plurality of dome ribs extend across the width of the domed portion and are in parallel along with the length of the domed portion.

In other embodiments of the invention, the pre-fabricated domed skylight panel assembly is configured for stacking with other pre-fabricated domed skylight panel assemblies.

In still other embodiments of the invention, the pre-fabricated domed skylight panel assembly is the same width and length as decking panels within a decking system, and wherein the pre-fabricated domed skylight panel assembly is substituted for a decking panel in the decking system.

In yet other embodiments of the invention, the pre-fabricated domed skylight panel assembly is coupled to adjacent decking panels within a decking system in the same way as the decking panels within the decking system are coupled to other decking panels.

Another embodiment of the invention is a a roof decking system comprising a plurality of roof decking panels each comprising a decking male edge and a decking female edge; and at least one pre-fabricated domed skylight panel assembly. The pre-fabricated domed skylight panel assembly comprises a domed skylight, comprising at least a domed portion; a skylight male edge operatively coupled to the domed skylight; a skylight female edge operatively coupled to the domed skylight; and wherein the skylight male edge and the skylight female edge of the pre-fabricated domed skylight panel assembly are configured for operative coupling with the decking male edge and the decking female edge of adjacent decking panels from the plurality of roof decking panels.

In further accord with embodiments of the invention, the skylight male edge is a male rail edge and the female skylight edge is a female rail edge, and wherein the male rail edge and the female rail edge are components of rail edge assemblies. The rail edge assemblies further comprise sealant operatively coupled to a top surface of the domed skylight and a bottom surface of the male rail edge and the female rail edge; flashing operatively coupled to a bottom surface of the domed skylight; fasteners; and wherein the fasteners operatively couple the domed skylight to the male rail edge and the flashing, and to the female rail edge and the flashing.

In other embodiments of the invention, the skylight male edge is a male panel edge and the skylight female edge is a female panel edge; and wherein the male panel edge and the female panel edge are components in panel edge assemblies and formed from a decking panel with a decking panel aperture configured for receiving the domed skylight. Each panel edge assembly further comprises sealant operatively coupled to a top surface of the domed skylight and a bottom surface of the decking panel; flashing operatively coupled to a bottom surface of the domed skylight; fasteners; and wherein the fasteners operatively couple the domed skylight to the male panel edge and the flashing, and to the female panel edge and the flashing.

To the accomplishment of the foregoing and the related ends, the one or more embodiments of the invention comprise the features hereinafter fully described and particularly pointed out in the claims. The following description and the annexed drawings set forth certain illustrative features of the one or more embodiments. These features are indicative, however, of but a few of the various ways in which the principles of various embodiments may be employed, and this description is intended to include all such embodiments and their equivalents.

BRIEF DESCRIPTION OF THE SEVERAL VIEWS OF THE DRAWINGS

The foregoing and other advantages and features of the invention, and the manner in which the same are accomplished, will become more readily apparent upon consideration of the following detail description of the invention taken in conjunction with the accompanying drawings, which illustrate embodiments of the invention and which are not necessarily drawn to scale, wherein.

DETAILED DESCRIPTION OF EMBODIMENTS OF THE INVENTION

Figure 1:
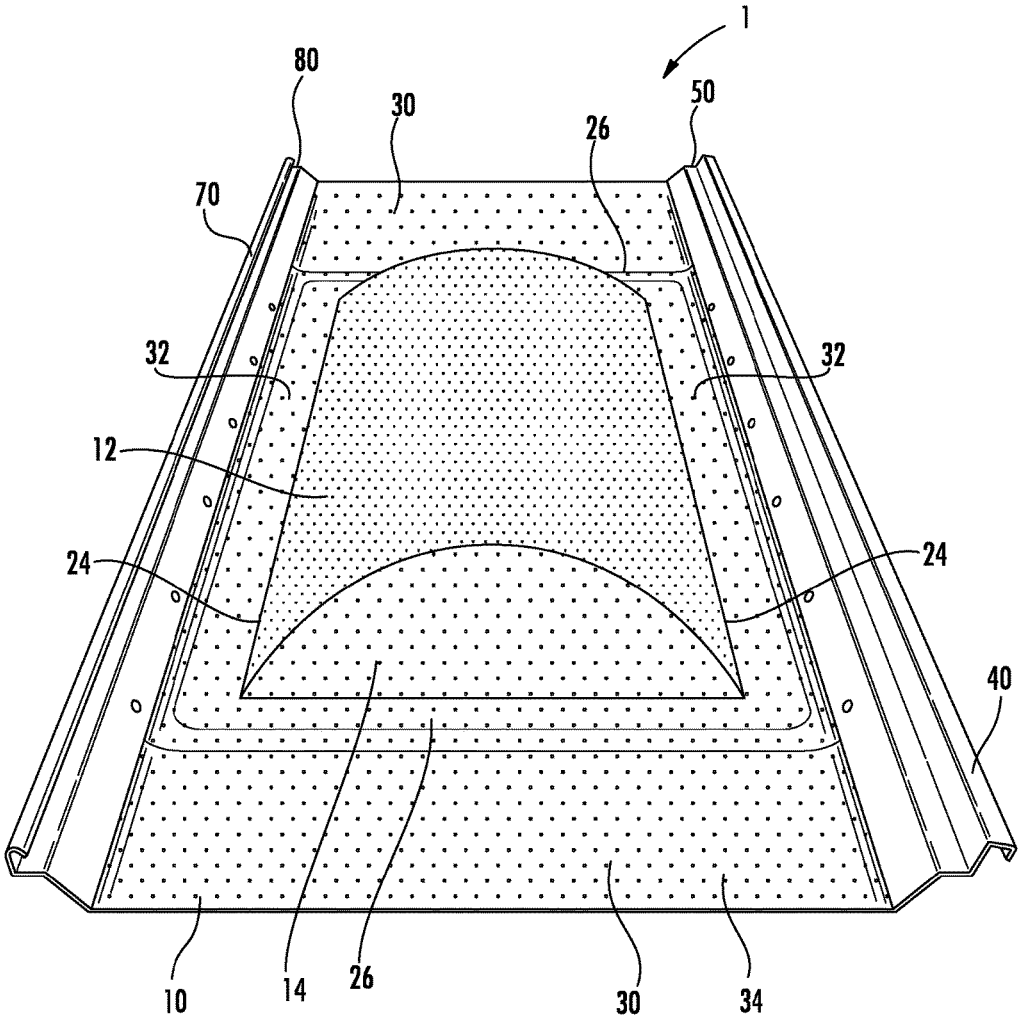
FIG. 1 illustrates a perspective top view of a pre-fabricated domed skylight panel assembly formed by coupling the domed skylight to rails, in accordance with embodiments of the invention.
Figure 2:
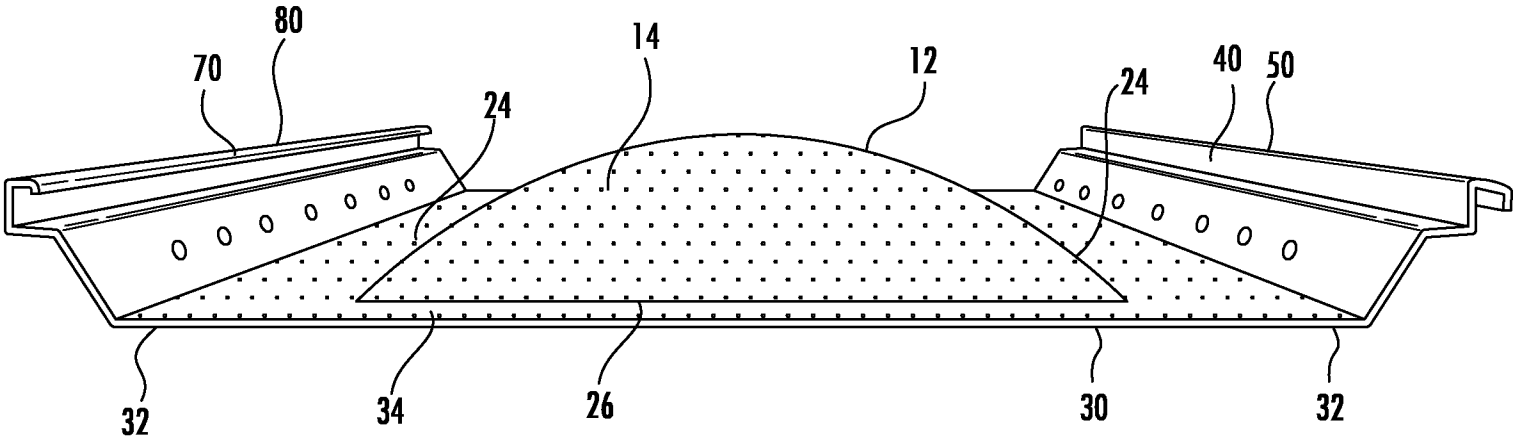
FIG. 2 illustrates a perspective end view of a pre-fabricated domed skylight panel assembly formed by coupling the domed skylight to rails, in accordance with embodiments of the invention.
Figure 3:
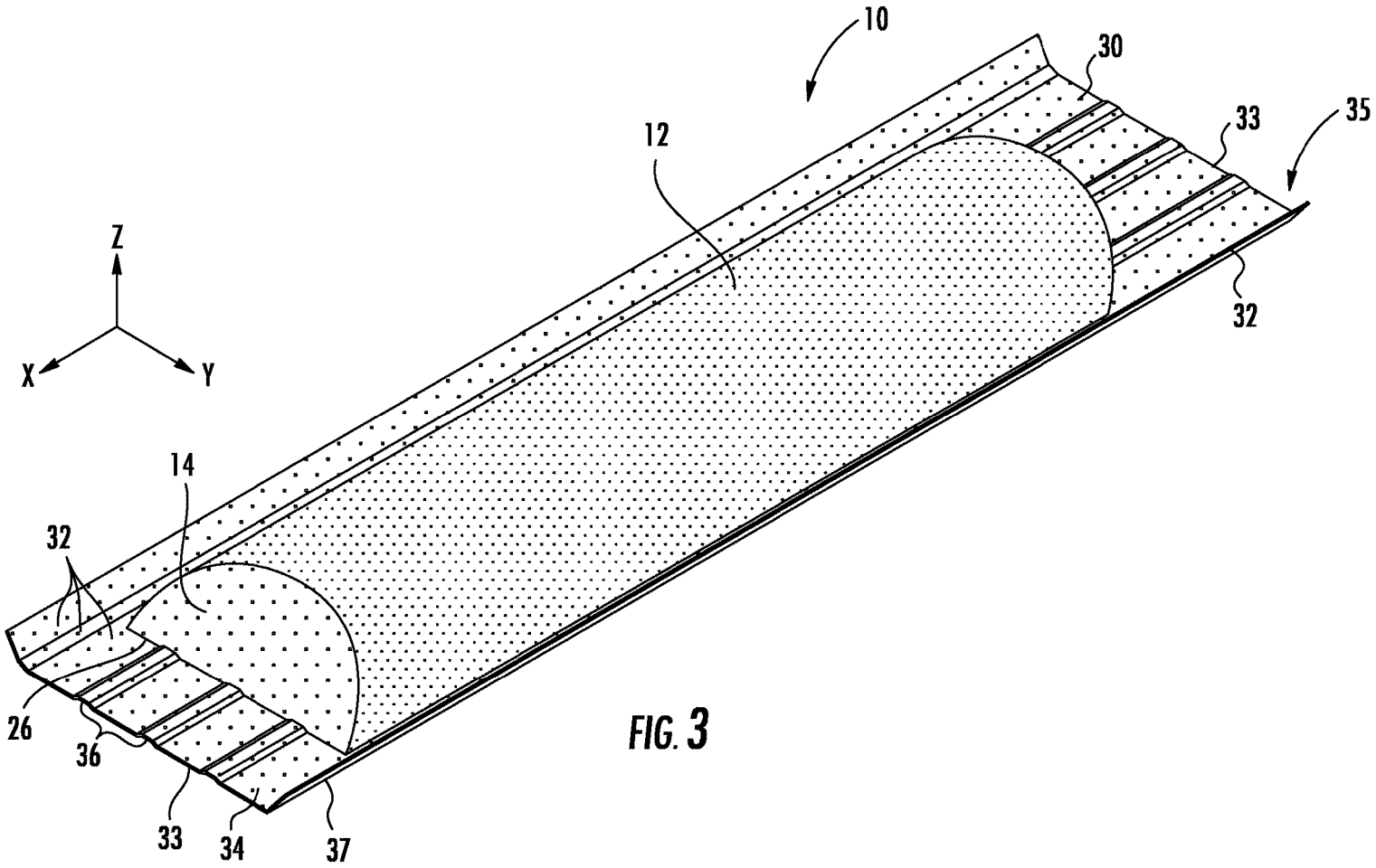
FIG. 3 illustrates a perspective view of a domed skylight with angled dome ends configured for coupling to rails or within a panel aperture, in accordance with embodiments of the invention.
Figure 4:
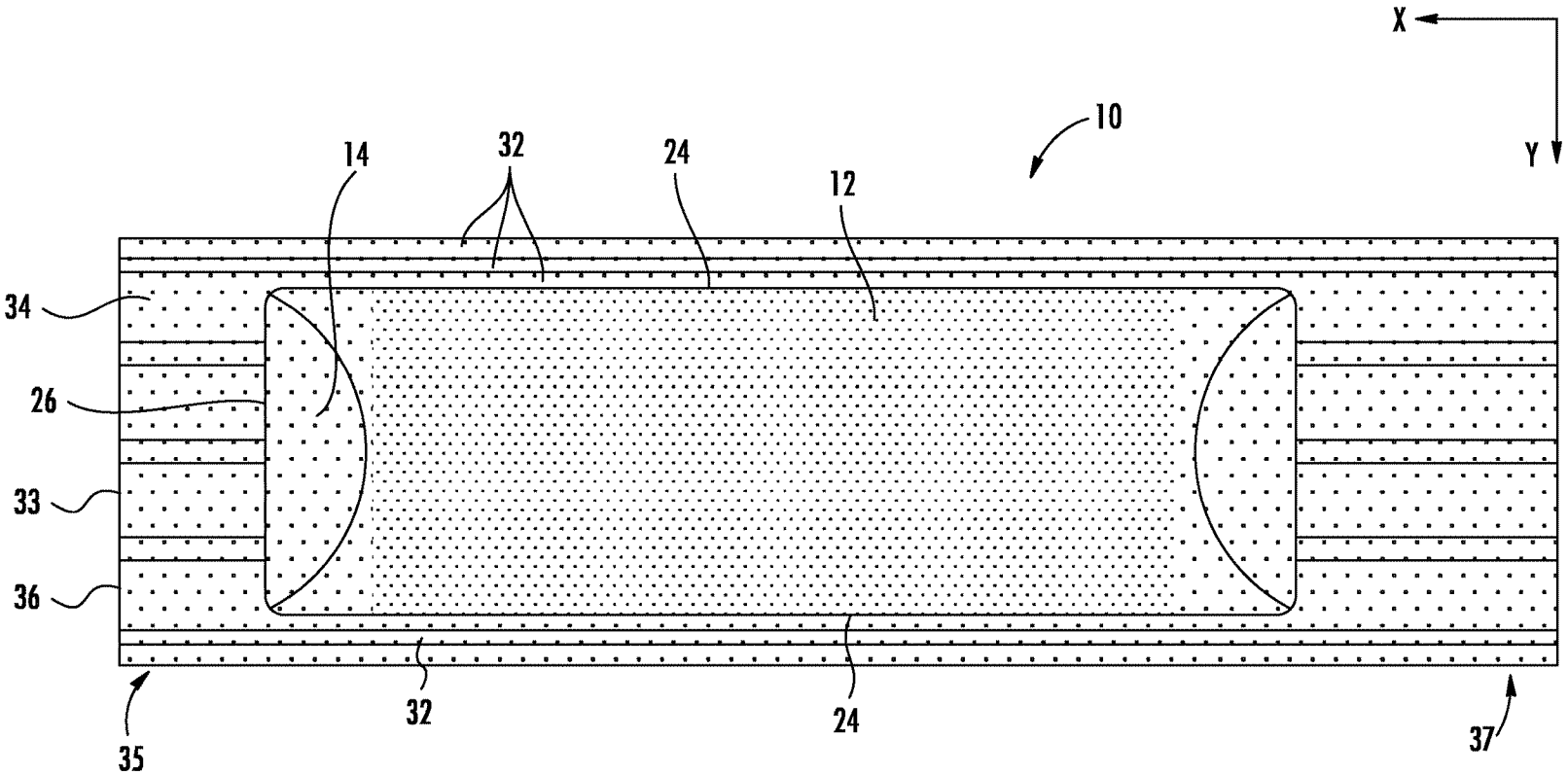
FIG. 4 illustrates a top view of the domed skylight of FIG. 3, in accordance with embodiments of the invention.
Figure 5:
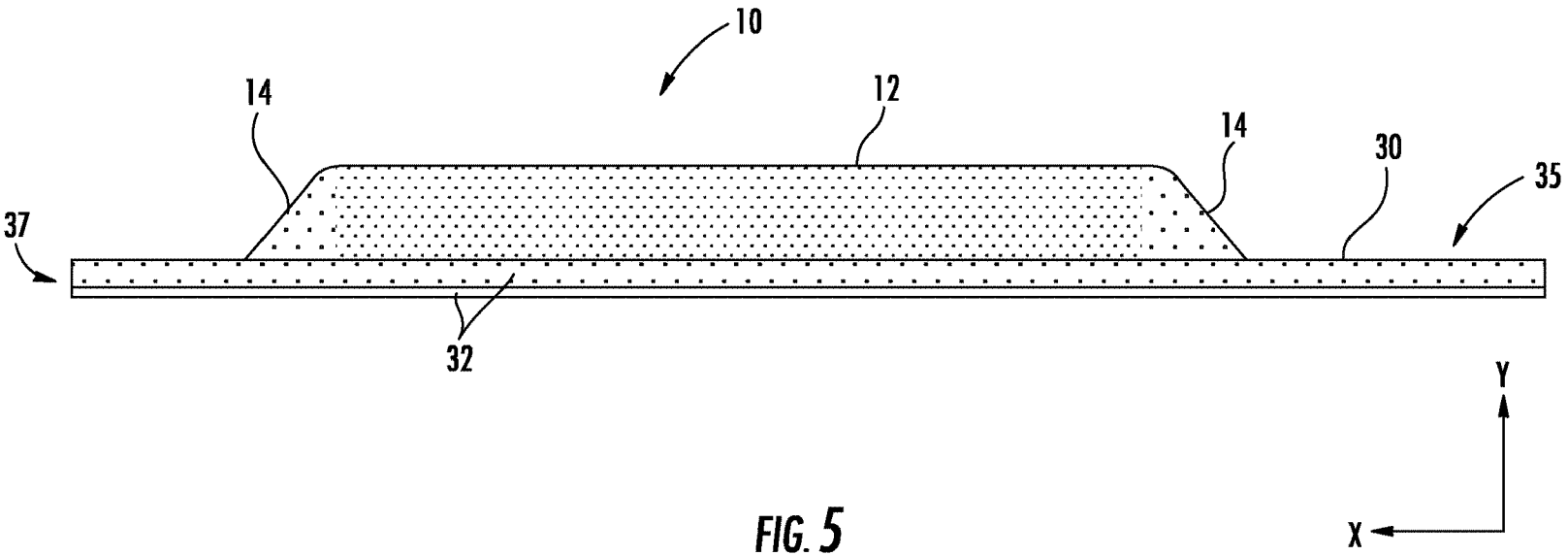
FIG. 5 illustrates a side view of the domed skylight of FIG. 3, in accordance with embodiments of the invention.
Figure 6:
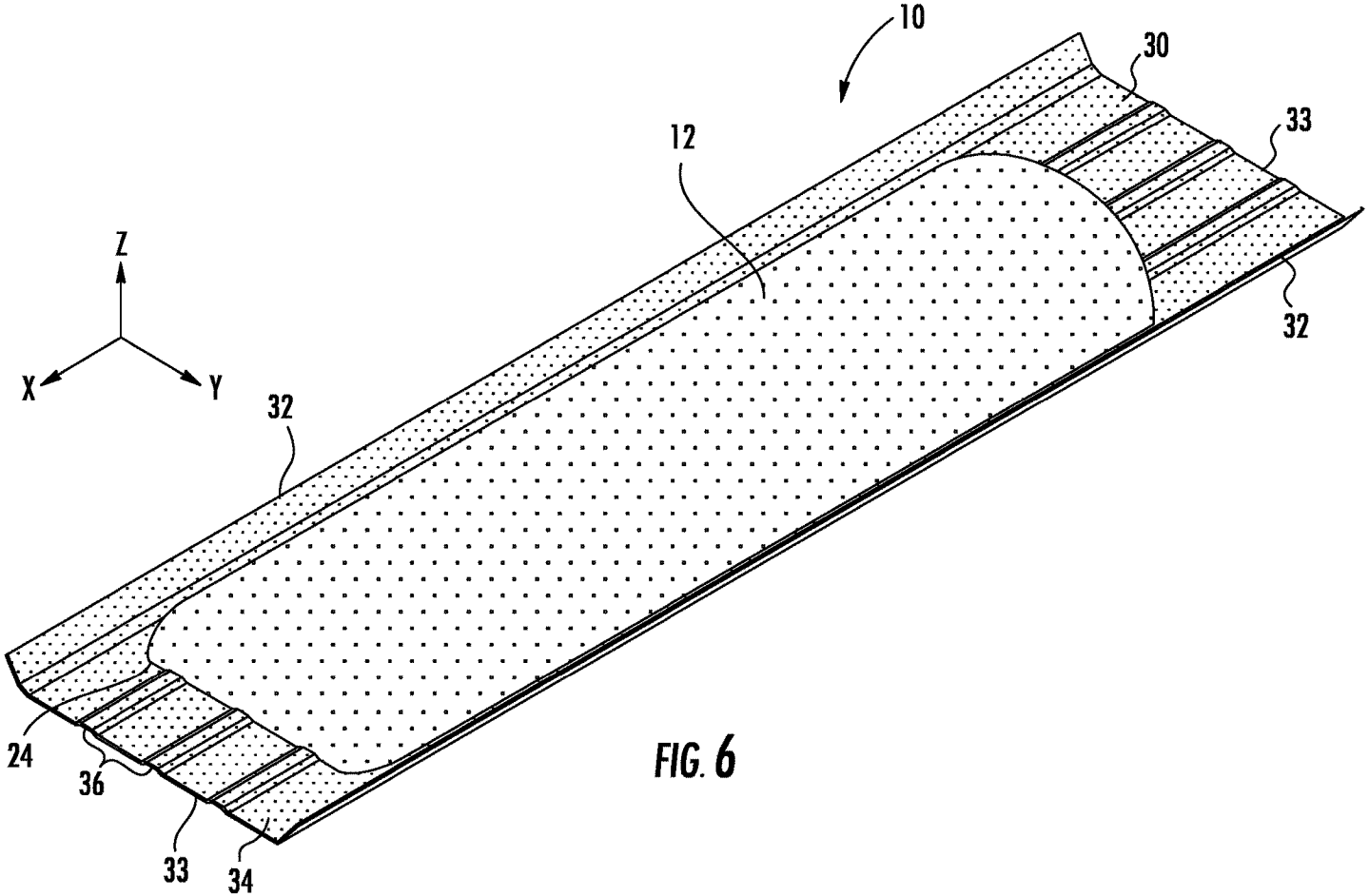
FIG. 6 illustrates a perspective view of a domed skylight without angled dome ends that is configured for coupling to rails or within a panel aperture, in accordance with embodiments of the invention.
Figure 7:
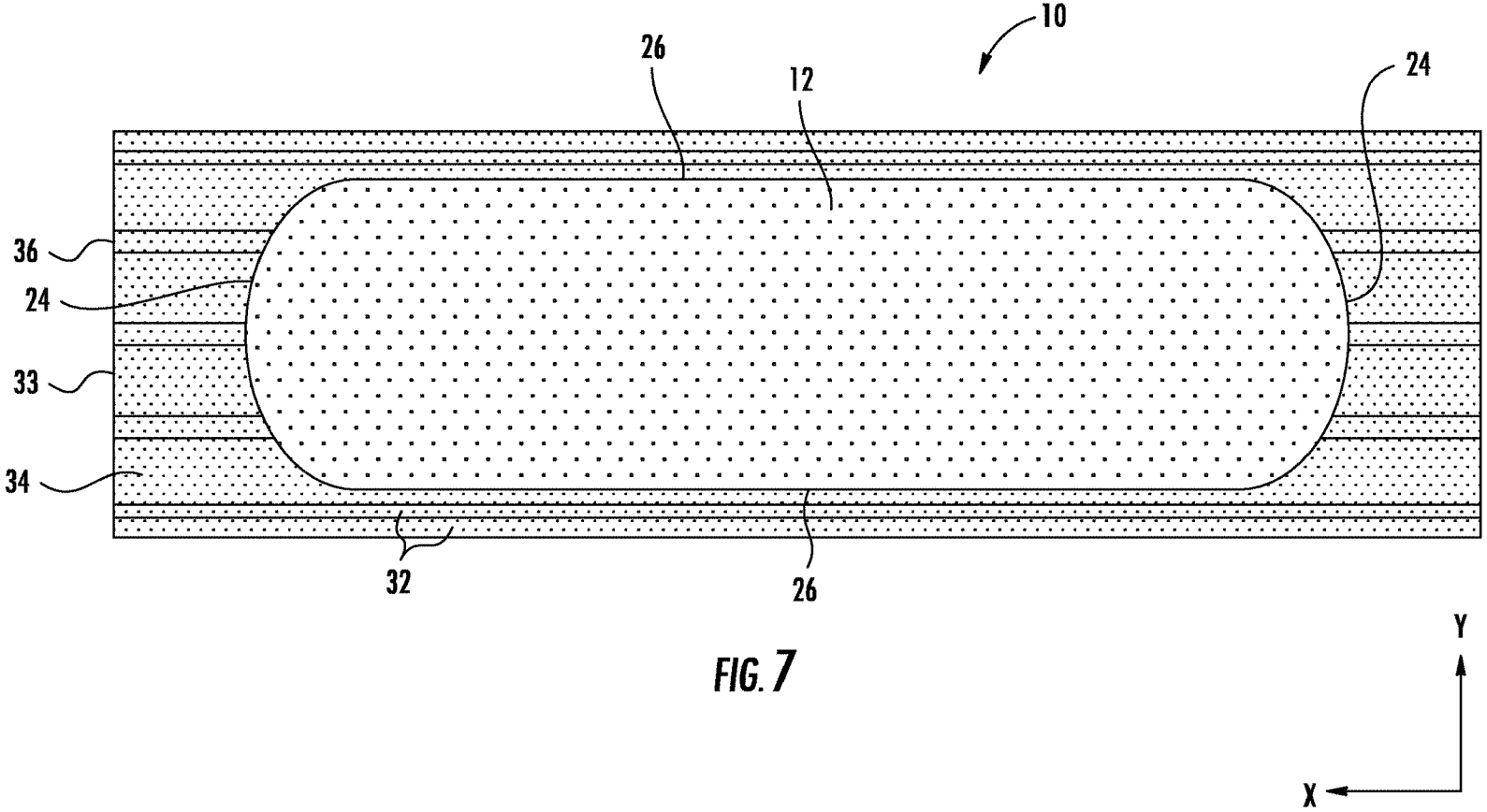
FIG. 7 illustrates a top view of the domed skylight of FIG. 6, in accordance with embodiments of the invention.
Figure 8:
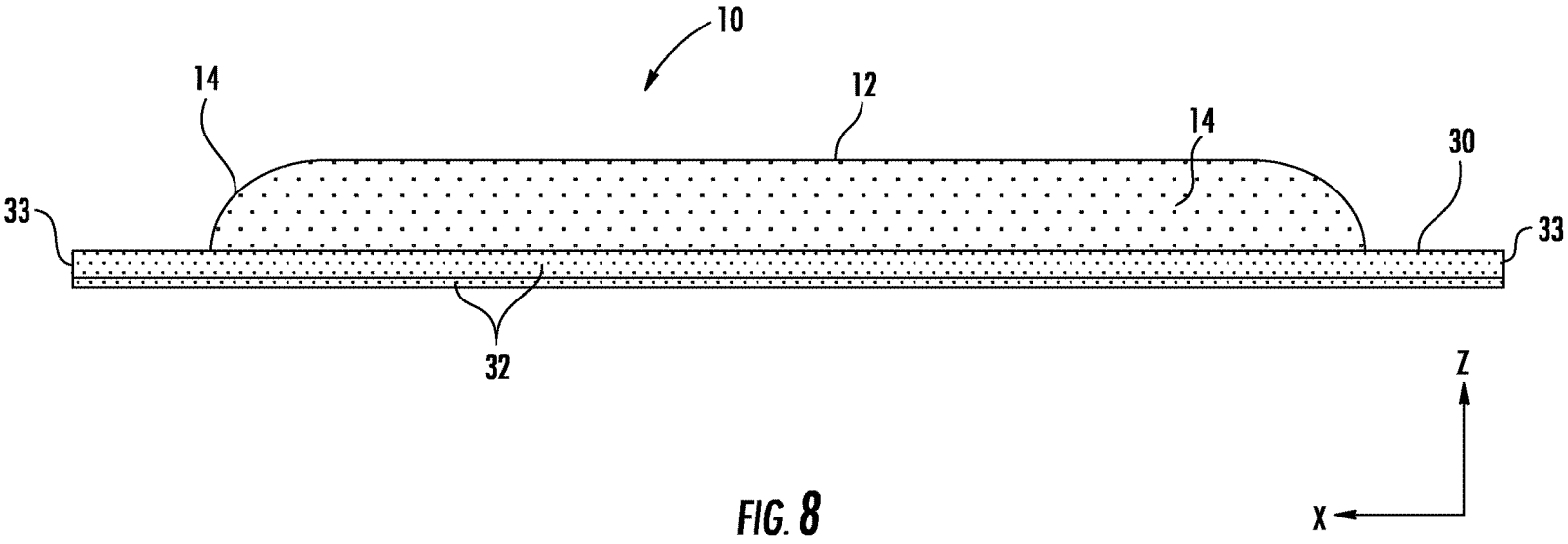
FIG. 8 illustrates a side view of the domed skylight of FIG. 6, in accordance with embodiments of the invention.

Embodiments of the present invention will now be described more fully hereinafter with reference to the accompanying drawings, in which some, but not all, embodiments of the invention are shown. Indeed, the invention may be embodied in many different forms and should not be construed as limited to the embodiments set forth herein; rather, these embodiments are provided so that this disclosure will satisfy applicable legal requirements. Like numbers refer to like elements throughout.

FIGS. 1-11 illustrate a pre-assembled domed skylight panel assembly 1 and components thereof in which the domed skylight 10 is operatively coupled to rail edge assemblies 40, 70. The domed skylight 10 may be formed as a single integral piece or multiple pieces, such as a domed skylight portion 12 and a pane skylight portion 30 (or additional separate portions). The domed portion 12 may be operatively coupled to the pane skylight portion 30 using a watertight sealant or another like means to create the domed skylight 10. In other embodiments, the domed portion 12 may be integrally formed with the pane skylight portion 30 to create a continuous domed skylight 10. In other embodiments, the domed skylight 10 may be formed from more than two portions and operatively coupled through a sealing means. The domed portion 12 of the domed skylight 10 may be formed in a generally curved configuration that may be semi-circular, semi-oval, triangular, irregular, or any other type of shape (e.g., triangular, rectangular, square, or the like) in which at least a portion of the domed portion 12 of the domed skylight 10 extends above the pane skylight portion 30 of the domed skylight 10. In some embodiments, the domed portion 12 may have dome ends 14 that are vertical, angled, curved or the like and which run continuously into the pane skylight portion 30 of the domed skylight 10. The dome (e.g., curved portion) of the domed portion 12 of the skylight may extend across the width (e.g., y-axis) of the domed skylight 10, and run for a specified length (e.g., x-axis) of the domed skylight 10 (as illustrated in the figures). In some embodiments of the invention the dome may extend across the length (e.g., x-axis) of the domed skylight 10. In other embodiments the dome may extend across both the width and length of the domed skylight 10. In some embodiments of the invention the domed portion 12 of the domed skylight 10 has dome ribs, and moreover, in some embodiments the pane skylight portion 30 may also have pane ribs 36, both of which may provide structural support within the pre-fabricated domed skylight panel assembly and within a decking system as a whole. The domed portion 12 of the domed skylight 10 may be defined between a set of length-wise domed edges 24 and a set of width-wise domed ends 26 that set the footprint of the domed portion 12 of the domed skylight 10.

The domed portion 12 may have one or more dome ribs that run transversely across the width of domed portion 12 (e.g., y-axis) in successive dome ribs that are parallel (or substantially parallel) to each other as they are spaced along the longitudinal axis (e.g., x-axis) of the domed skylight 10. In other embodiments of the invention the dome ribs may run longitudinally along the length of the dome portion 12 (e.g., x-axis). However, in still other embodiments of the invention the dome ribs may be formed in the domed portion 12 in any orientation (e.g., at any angle, in different angles, in multiple angles, in both the transverse and longitudinal direction on different portions of the domed portion 12, in a zig-zag configuration, curved configuration, or any other like configuration). The dome ribs may be formed by extending the dome ribs outwardly from the domed portion 12, and thus, adjacent dome ribs form dome troughs within the domed portion 12 (e.g., the dome troughs may be the external surface of the domed portion 12 if the dome ribs were not located on the domed portion 12). In other embodiments, the dome ribs may be formed by extending dome troughs inwardly into the domed portion 12, and thus, adjacent dome troughs form domed ribs within the domed portion 12 (e.g., the dome ribs may be the external surface of the domed portion 12 if the dome troughs were not located in domed portion 12). The dome ribs may be formed with a top 20 that is rectangular, or any other shaped top (e.g., circular, oval, triangular, trapezoidal, irregular, or any other type of shape). The rib tops themselves may be flat, semi-circular, semi-oval, triangular, or any other type of shape. The dome ribs may have rib sides that are vertical, curved, angled, or the like between the rib tops and the dome troughs.

In some embodiments the dome ribs may be the same size along the entire length of the ribs. Alternatively, the dome ribs may have narrower sections and wider sections. For example, the dome ribs may be narrower at the top of the dome portion 12, and have an increased width as the dome ribs run towards the pane skylight portion 30 (or vice versa). As such, the dome ribs and dome troughs may have a triangular appearance when viewed from the side, and the dome troughs (or the dome ribs in other embodiments) may have the appearance of an almond or eye shape when viewed from the top. It should be understood that the dome ribs and dome troughs may have any type of configuration and shape that results in the desired structural support, light captured and/or directed into the building, ease of shipping and assembly, and/or other features of the present invention.

As illustrated in FIGS. 3 through 8 in some embodiments of the invention the pane skylight portion 30 of the domed skylight 10 may have pane skylight edges 32 that extend in a direction opposite from the length-wise domed edges 24 of the domed portion 12, and in some embodiments at least a portion of the skylight edges 32 are angled upwardly from the x-y plane (e.g., horizontal plane) of the domed skylight 10. The pane skylight edges 32 of the pane skylight portion 30 of the domed skylight 10 allow for the coupling of the domed skylight 10 to the edge assemblies 40, 70, 140, 170 as will be described in further detail later with respect to the other figures. Moreover, as illustrated in FIGS. 3 through 8 in some embodiments of the invention the pane skylight portion 30 of the domed skylight 10 may have pane skylight ends 33 that extend in a direction opposite from the width-wise domed ends 26 of the domed portion 12. As such, the pane skylight edges 32 and pane skylight ends 33 of the pane skylight portion 30 create a dome skylight 10 with a pane skylight trough 34. In other embodiments of the invention, the pane skylight edges 32 may be formed in any shape (e.g., any upward angle, downward angle, flat, notches, bend, folds, or the like) in order to allow for the connection of the domed skylight 10 into a pre-fabricated domed skylight panel assembly 1. It should be understood that the pane skylight edges 32 and pane skylight ends 33 may be integral with, or be a part of the domed edges 24 and domed ends 26. The term skylight edge may include the domed skylight edge 24 or the pane skylight edge 32, while the term skylight end may include the domed end 26 or the pane skylight end 33.

Figure 9:
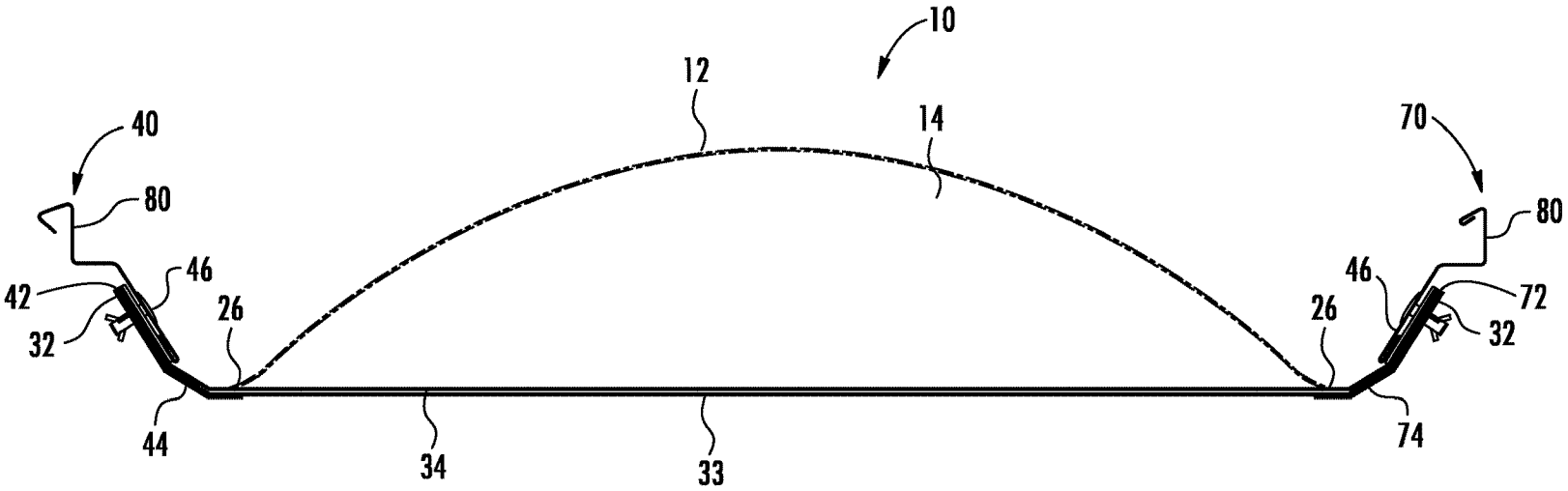
FIG. 9 illustrates a cross-sectional view of a pre-fabricated domed skylight panel assembly, in accordance with embodiments of the invention.
Figure 10:
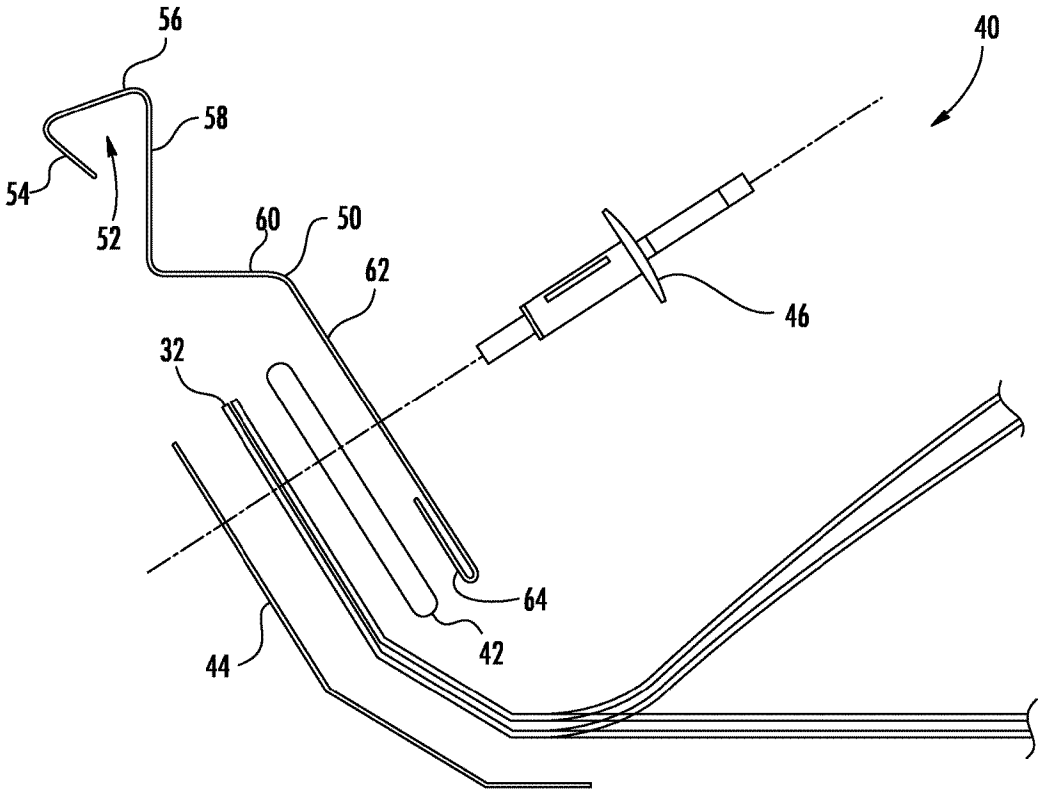
FIG. 10 illustrates an enlarged exploded view of the female rail edge of the cross-sectional view of the pre-fabricated domed skylight panel assembly illustrated in FIG. 9, in accordance with embodiments of the invention.

FIGS. 1, 2, and 9-11 illustrate how the domed skylight 10 is operatively coupled to the rail edge assemblies 40, 70, in one embodiment of the invention. As illustrated by FIG. 9, the domed skylight 10 is operatively coupled to a female rail edge assembly 40 on one pane skylight edge 32 and a male rail edge assembly 70 on the opposite pane skylight edge 32. FIG. 10 provides an enlarged exploded view of the female rail edge assembly 40 from FIG. 9. As illustrated in FIG. 10 the female rail edge assembly 40 comprises a female rail edge 50, a sealant 42 (e.g., a mastic, adhesive, cement, bonding material, combination thereof, or the like), a flashing 44 (e.g., pane edge flashing), and a fastener 46. As illustrated by FIG. 10, the sealant 42 is overlaid on top of a pane skylight edge(s) 32 of the domed skylight 10 (e.g., on any portion including a flat first portion, a bent second portion, a bent third portion, combination of these portions, or the like). The female rail edge 50 is overlaid on top of the sealant 42 and the flashing 44 is placed behind the pane skylight edge 32 of the domed skylight 10 (e.g., with or without a sealant, adhesive, cement, or the like). A fastener (e.g., a rivet, bolt and nut, other fastening means, or the like) fastens the pane skylight edge 32, the female rail edge 50, the sealant 42, and the flashing 44 together. FIG. 10 illustrates that the fastener 46 operatively couples the female rail edge 50 on the pane skylight edge 32 that is extending upwardly from the pane skylight portion 30 (e.g., the bent third portion, or another like portion); however, it should be understood that the fastening may occur at other locations on or near the pane skylight edge(s) 32 (e.g., the flat first portion as discussed later, the bent second portion, or any other portion that is in the flat x-y plane or bent out of the x-y plane). In the illustrated embodiment in FIGS. 9 and 10 the female rail edge 50 only extends the length of the bent portion (e.g., a bent third portion) of the pane skylight edge 32. In other embodiments, the female rail edge 50, the sealant 42, and the flashing 44 may be extended into the trough 34 of the pane skylight portion 30 of the domed skylight 10 (or may only be located in the trough 34). FIG. 10 illustrates that in one embodiment the fastener is a rivet; however it should be understood that in other embodiments of the invention other fasteners may be used, such as other mechanical fasteners, liquid or solid fasteners that harden to create a water tight seal at the rail edge assemblies 40, 70, a combination of both, or other like fasteners.

The female rail edge 50 may have a cavity 52 that is formed by bending one or more legs into the desired cavity 52. As such, the female rail edge 50 may have a first leg 54, a second leg 56, a third leg 58 extending in a substantially vertical orientation, a fourth leg 60 extending in a substantially horizontal orientation, a fifth leg 62 extending at the same or similar angle(s) as the pane skylight edge(s) 32 of the pane skylight portion 30, and a sixth leg 64 that is bent back upon the fifth leg 62. The sixth leg 64 may be bent outwardly or inwardly (as preferably illustrated in FIG. 10). Despite the specific female rail edge 50 illustrated herein, it should be understood that the present invention may be utilized within any type of seam configuration for use within structural steel decking.

Figure 11:
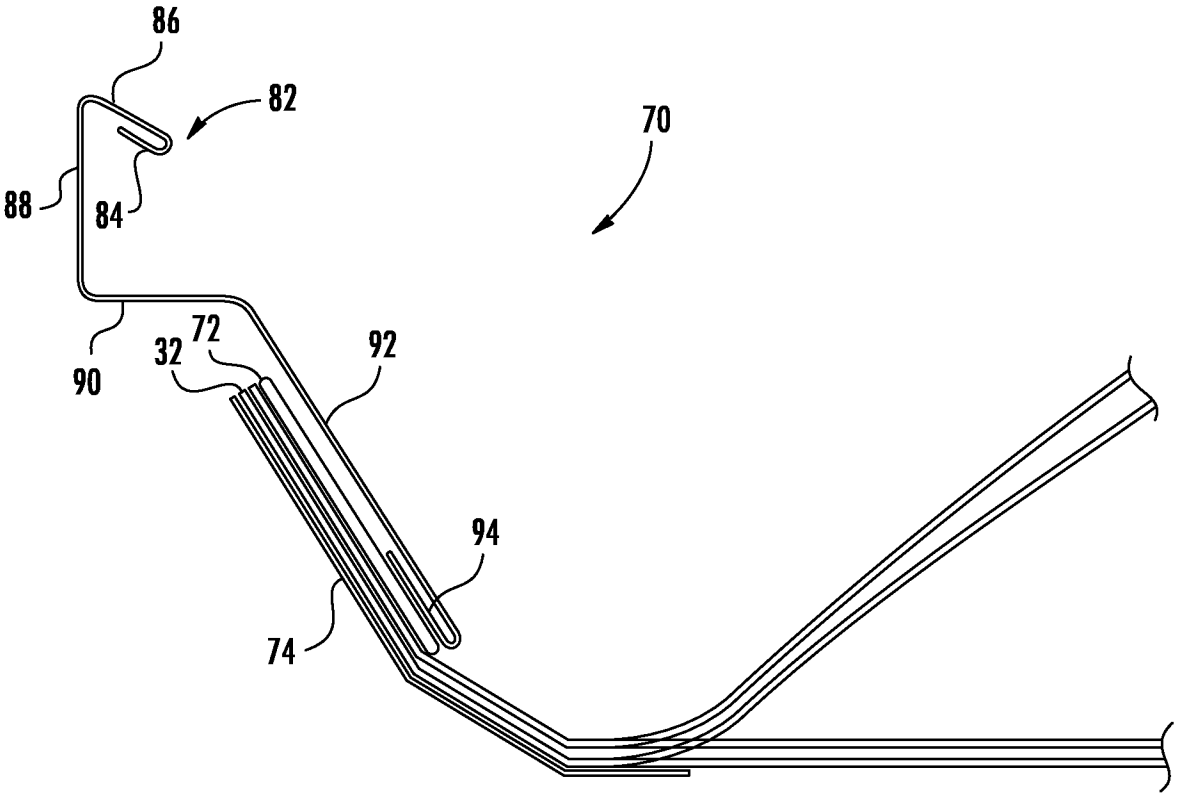
FIG. 11 illustrates an enlarged reverse view of the male rail edge of the cross-sectional view of the pre-fabricated domed skylight panel assembly illustrated in FIG. 9, in accordance with embodiments of the invention.

FIG. 11 provides an enlarged exploded view of the male rail edge assembly 70 from FIG. 9. As illustrated in FIG. 10 the male rail edge assembly 70 comprises a male rail edge 80, a sealant 72 (e.g., a mastic, adhesive, cement, bonding material, combination thereof, or the like), flashing 74 (e.g., pane edge flashing), and a fastener (not shown). Like the female rail edge assembly 40, as illustrated in FIG. 11 the sealant 72 is overlaid on top of a pane skylight edge(s) 32 (e.g., the bent third portion, or another like portion) of the domed skylight 10. The male rail edge 80 is overlaid on top of the sealant 72 and the flashing 74 is placed behind the pane skylight edge 32 of the domed skylight 10. A fastener (e.g., like the fastener 46) fastens the pane skylight edge 32, the male rail edge 80, the sealant 72, and the flashing 74 together. Like the female rail assembly 40, the fastener on the male rail edge assembly 70 operatively couples the male rail edge 80 on the pane skylight edge 32 that is extending in the upward direction; however, it should be understood that the fastening may occur at other locations on or near the pane skylight edge(s) 32. In the illustrated embodiment in FIGS. 9 and 11 the male rail edge 80 only extends the length of the bent portion (e.g., a bent third portion) of the pane skylight edge 32. In other embodiments, the male rail edge 80, the sealant 42, and the flashing 44 may be extended into the trough 34 of the pane skylight portion 30 of the domed skylight 10 (or may only be located in the trough 34). As previously illustrated in FIG. 10, in one embodiment the fastener is a rivet; however, it should be understood that in other embodiments of the invention other fasteners may be used, such as other mechanical fasteners, liquid or solid fasteners that harden to create a water tight seal at the rail edge assemblies 40, 70, a combination of both, or other like fasteners.

The male rail edge 80 may have a tab 82 (e.g., single tab, double tab folded back upon one another, or the like) that is configured for coupling with the female cavity 52. The male rail edge 80 is formed by bending one or more legs into the desired profile. As such, the male rail edge 80 may have a first leg 84 and a second leg 86. The first leg 84 may be bent back upon the second leg 86 (outwardly or inwardly) to form the tab 82. The male rail edge 80 may further have a third leg 88 extending in a substantially vertical orientation, a fourth leg 90 extending in a substantially horizontal orientation, a fifth leg 92 extending at the same or similar angle as the pane skylight edge 32 of the pane skylight portion 30, and a sixth leg 94 that is bent back upon the fifth leg 92. The sixth leg 94 may be bent outwardly or inwardly (as illustrated). Despite the specific male rail edge assembly 70 illustrated herein, it should be understood that the present invention may be utilized within any type of seam configuration for use within structural steel decking.

It should be understood that the rail edges 50, 80 in the present invention may be formed by rolling just the rail apart from the rest of the panel. However, in other embodiments the rail edges 50, 80 may be formed by rolling an entire steel decking panel (or using an already rolled steel decking panel) and removing the trough potion of the steel decking panel from the rails. After the rails are removed additional processing may be performed (e.g., additional rolling of the cut edge) to create the desired rail edges 50, 80 for the pre-fabricated domed skylight panel assembly 1.

In some embodiments of the invention when a mechanical fastener is used, the pane skylight edge 32 of the domed skylight 10 or other components that form the rail assemblies 40, 70 may have pre-formed apertures through which the rail assemblies 40, 70 are coupled. In other embodiments, apertures may be formed before or after any one of the components of the rail edges 50, 80 are layered and operatively coupled together. As will be discussed in further detail later, the rail assemblies 40, 70 are operatively coupled to adjacent steel decking panels using the male and female rail edges 50, 80, while the pane skylight ends 33 may have apertures (e.g., pre-formed, post-formed, formed during assembly, or the like) or other sealing means (e.g., sealant, such as adhesive, or the like as previously discussed) through which the pane skylight ends 33 are operatively coupled to the ends of adjacent steel decking panels. In some embodiments of the invention, one of the pane skylight ends 33 (e.g., 35) may have a length that is longer than the other pane skylight end 33 (e.g., 37) (e.g., the domed portion 12 is offset within the pre-fabricated panel assembly), in order to overlap one end over an adjacent decking panel and one end under an adjacent decking panel, or for other like reasons.

Figure 12:
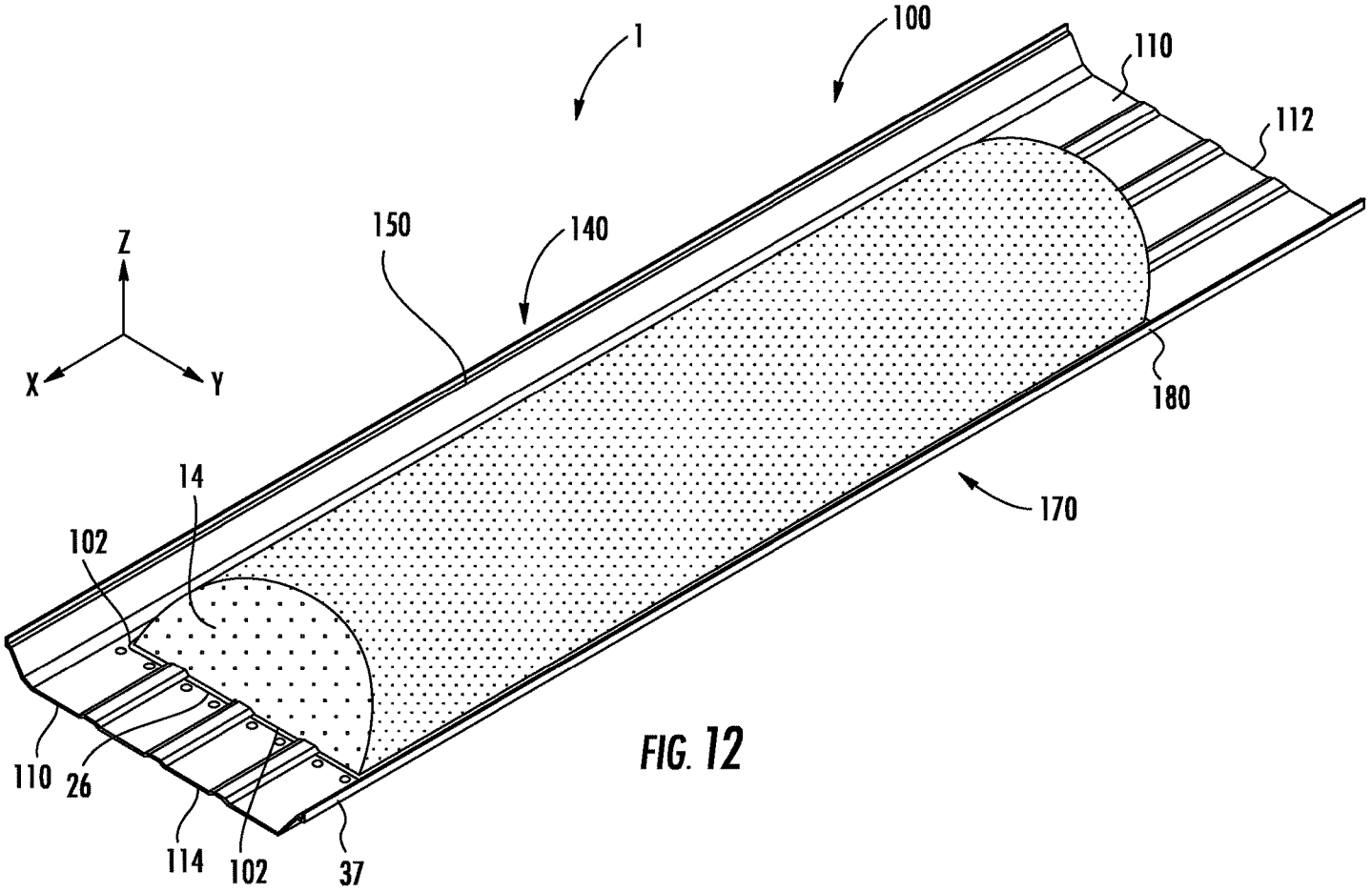
FIG. 12 illustrates a perspective view of a pre-fabricated domed skylight panel assembly with a domed skylight coupled within an aperture in a decking panel, in accordance with embodiments of the invention.
Figure 13:
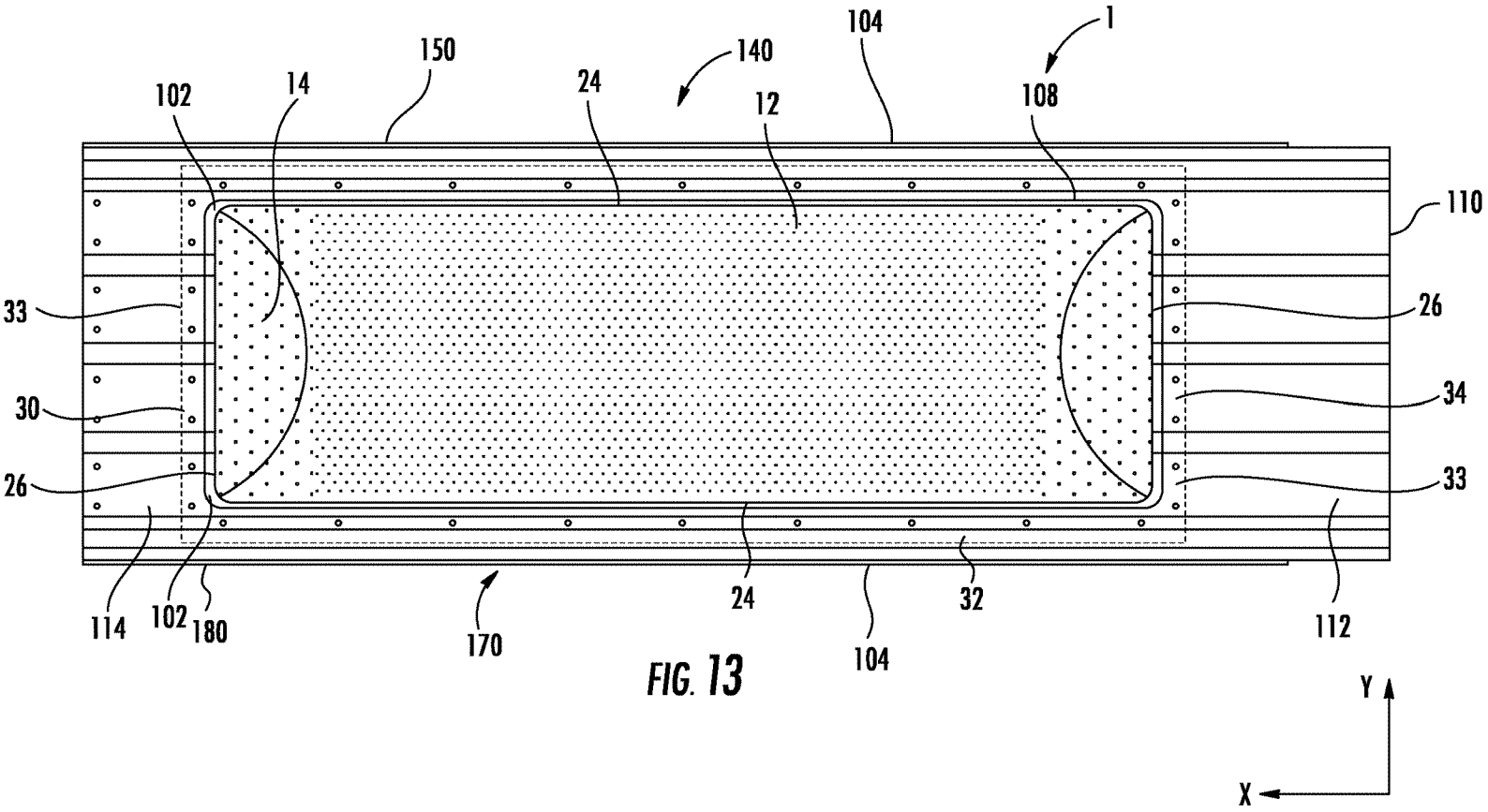
FIG. 13 illustrates a top view of the pre-fabricated domed skylight panel assembly of FIG. 12, in accordance with embodiments of the invention.
Figure 14:
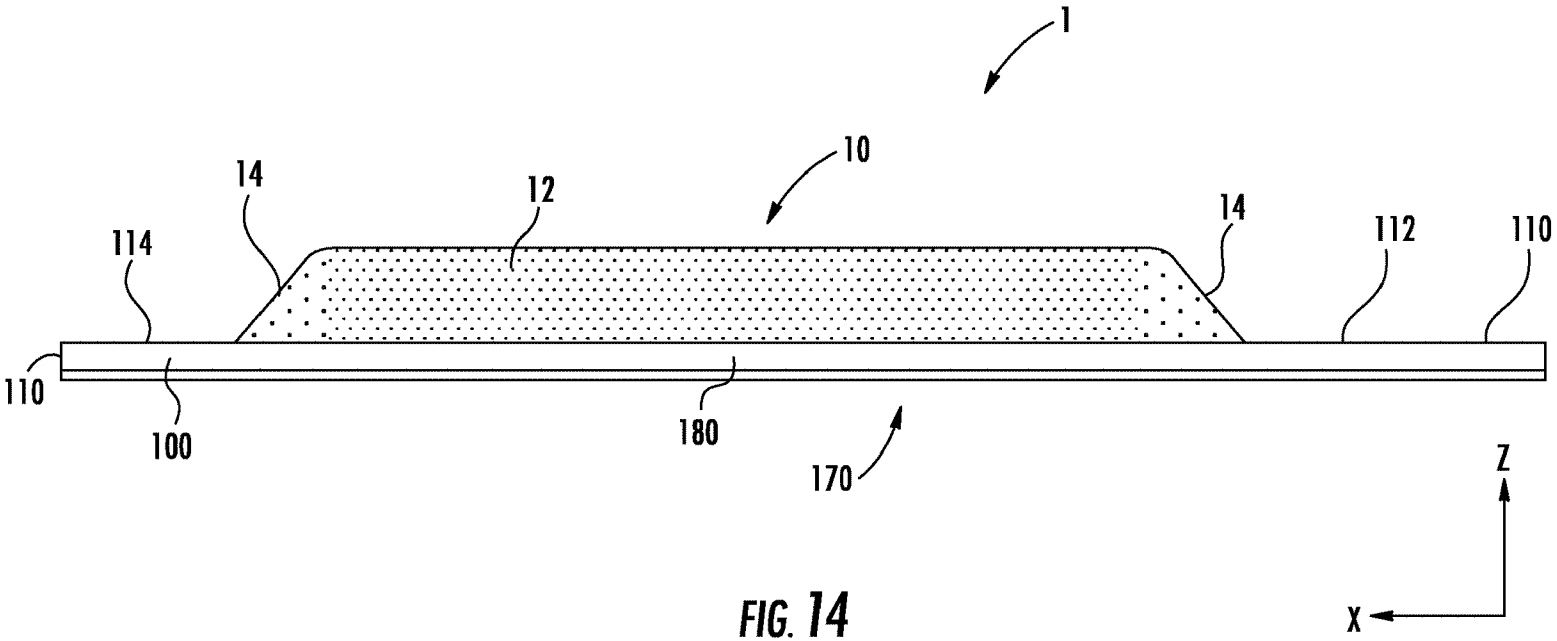
FIG. 14 illustrates a side view of the pre-fabricated domed skylight panel assembly of FIG. 12, in accordance with embodiments of the invention.

FIGS. 12 through 14 illustrate another embodiment of the pre-fabricated domed skylight panel assembly 1. A steel decking panel 100 may be procured (e.g., purchased or rolled) and a decking panel aperture 102 may be cut out into the steel decking panel 100 for receiving a domed skylight 10. The domed skylight 10 may be the same or similar to the domed skylights discussed with respect to FIGS. 1-11; however, in this embodiment of the invention the pane skylight portion 30 may or may not have a width as wide as previously discussed (e.g., may or may not have the pane skylight edges 32 with a portion that extends upwardly, or the like), and may not have a length with skylight ends 33 that are as long as previously discussed (e.g., the pane skylight portion 30 with the skylight ends 33 may be shorter than the length of the decking panel 100 in which the domed skylight 10 is inserted). As such, the domed portion 12 of the domed skylight 10 is configured for being received in the decking panel aperture 102 of the steel decking panel 100, but the pane skylight portion 30 (e.g., skylight edges 32 and skylight ends 33) of the domed skylight 10 is sized to prevent it from being able to pass through the decking panel aperture 102 of the steel decking panel 100. As discussed with respect to the domed skylight 10 in FIGS. 1-11, the domed skylight 10 illustrated in FIGS. 12-14 may have dome ends 14 and dome ribs, as was previously discussed with respect to the domed skylight 10 in FIGS. 1-11.

The domed skylight 10 may be operatively coupled to the steel decking panel 100 in the same or similar way as was previously discussed with respect to FIGS. 1-11. That is, the domed skylight 10 may have a pane skylight portion 30 with upwardly extending pane skylight edges 32, and the panel edge assemblies 140, 170 are coupled together at the upwardly extending pane skylight edges 32. However, as illustrated by FIGS. 15-17, other fastening means may be utilized to create a water tight seal when the domed skylight 10 is coupled to a steel decking panel 100 with a decking panel aperture 102.

Figure 15:
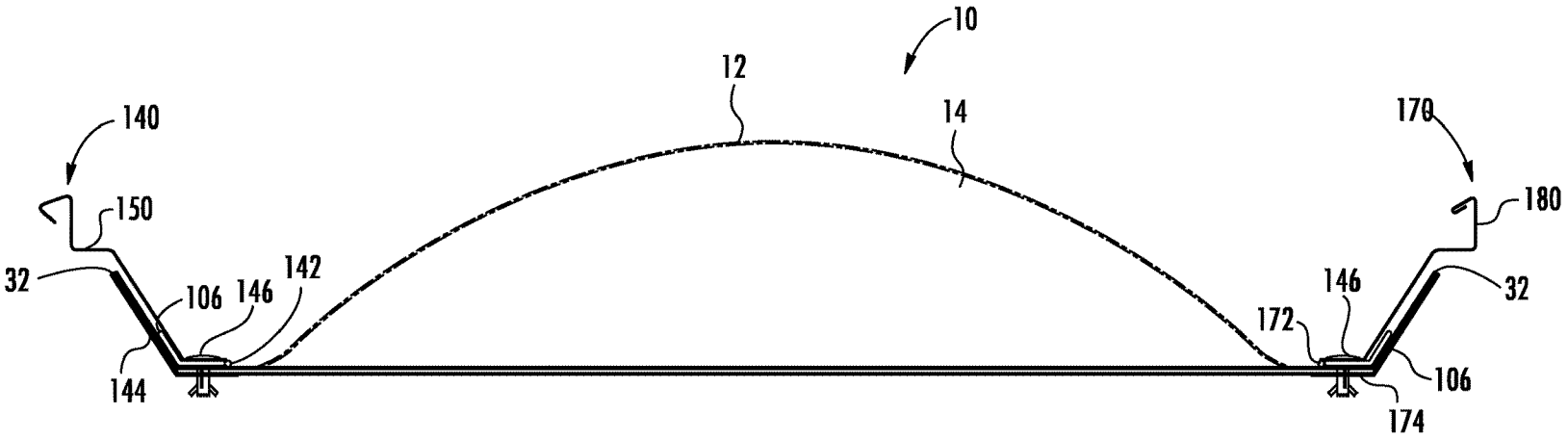
FIG. 15 illustrates a cross-sectional view of the pre-fabricated domed skylight panel assembly of FIG. 12, in accordance with embodiments of the invention.
Figure 16:
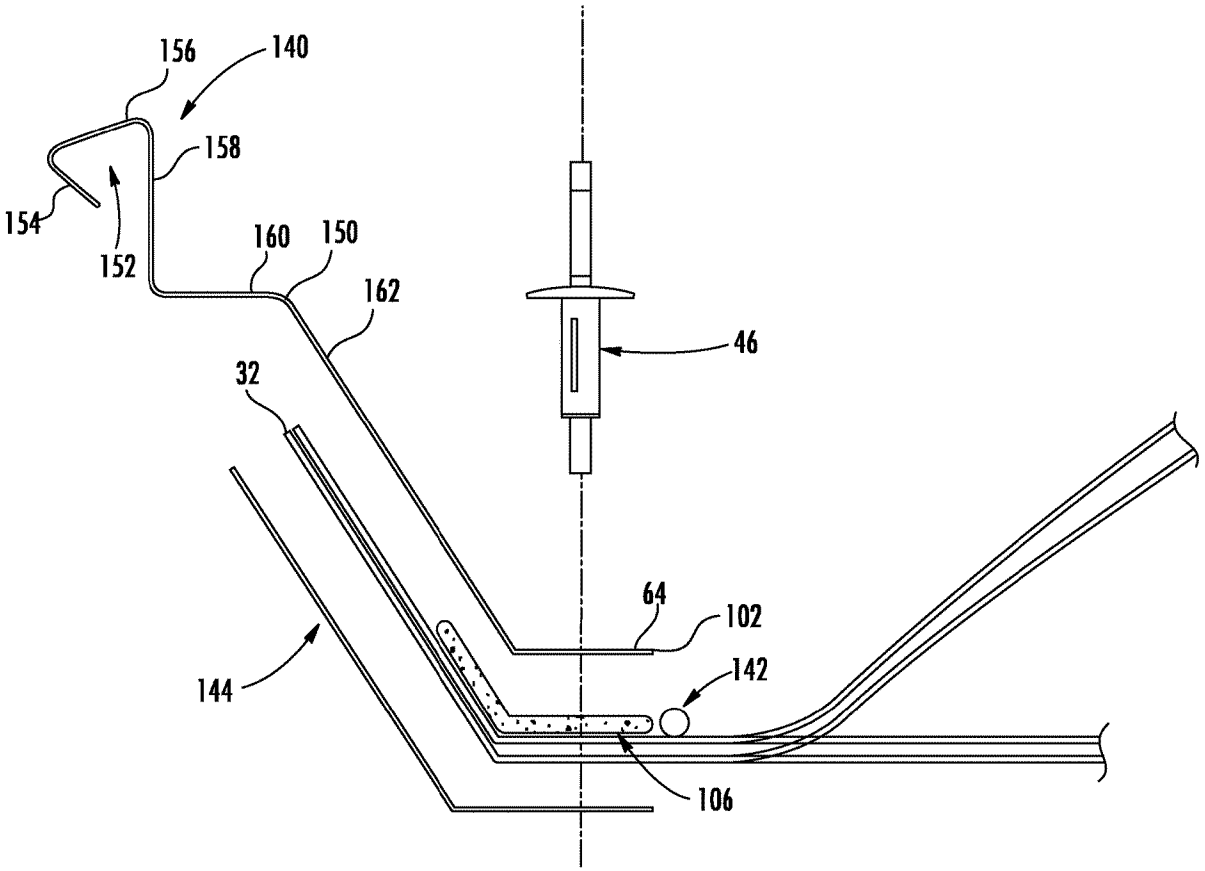
FIG. 16 illustrates an enlarged exploded view of the female edge of the cross-sectional view of the pre-fabricated domed skylight panel assembly illustrated in FIG. 15, in accordance with embodiments of the invention.
Figure 17:
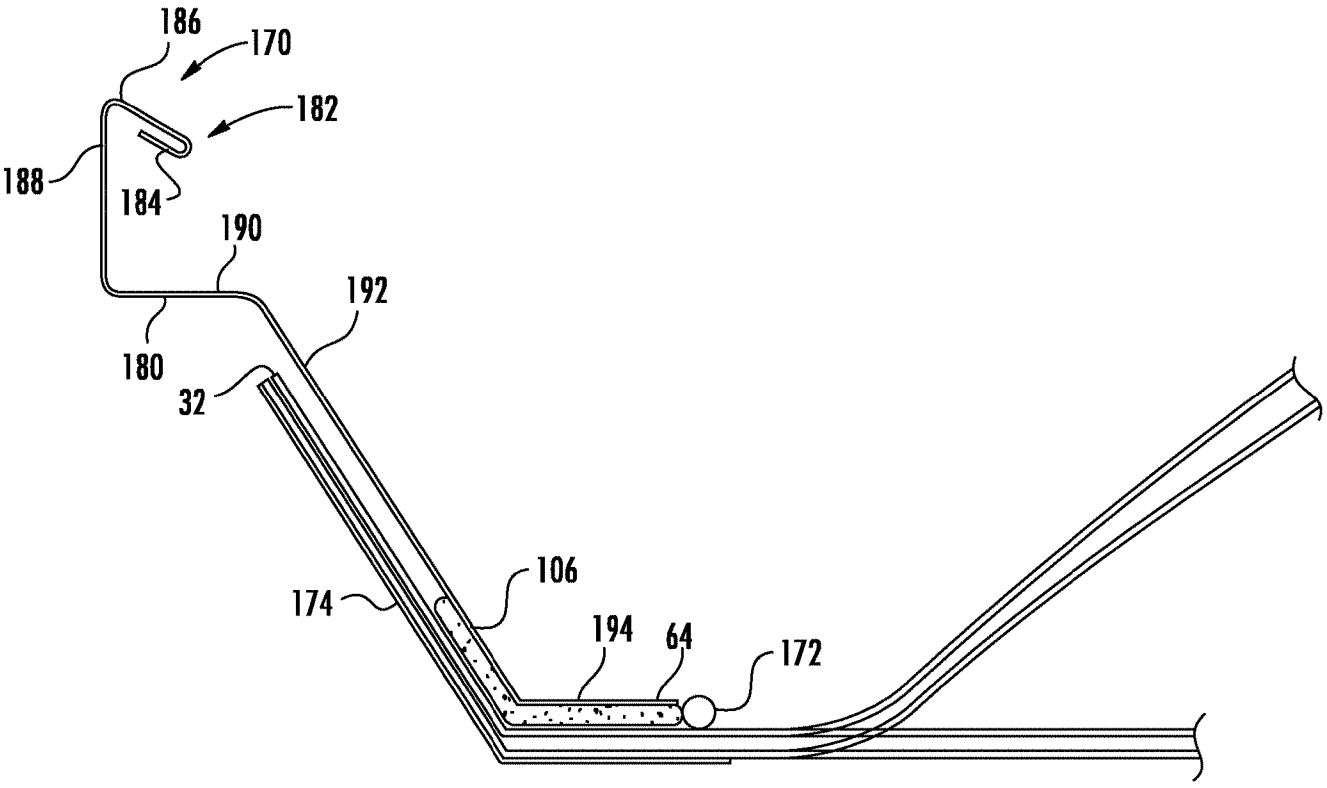
FIG. 17 illustrates an enlarged reverse view of the male edge of the cross-sectional view of the pre-fabricated domed skylight panel assembly illustrated in FIG. 15, in accordance with embodiments of the invention.

FIGS. 15-17 illustrate one embodiment of operatively coupling the domed skylight 10 to the steel decking panel 100 with the decking panel aperture 102 therein. As illustrated by FIG. 15, the domed skylight 10 is operatively coupled to a female panel edge assembly 140 on one edge 104 and a male panel edge assembly 170 on an opposite edge 104 of a steel decking panel 100. FIG. 16 provides an enlarged exploded view of the female panel edge assembly 140 from FIG. 15. As illustrated in FIG. 16 the female panel edge assembly 140 comprises a female panel edge 150, a sealant 142, flashing 144 (e.g., pane edge flashing), a fastener 146, and an adhesive 106 (or other sealant, or other attachment means). As illustrated by FIG. 16 the adhesive 106 (or other sealant, or other attachment means) is overlaid around the entire perimeter of the domed skylight 10, including the upward angled pane skylight edges 32 (on both sides of the width of the domed skylight 10) of the pane skylight edges 32 and the pane skylight ends 33 (on both ends) of the pane skylight portion 30. In some embodiments the adhesive 106 (or other sealant, or other attachment means) is only on a flat portion (e.g., in the x-y plane), is only on a bent portion (e.g., a bent second portion, a bent third portion, or the like), or on multiple portions of the pane skylight edges 32 (e.g., flat first portion and one or more bent portions, such as the flat first portion and the bent second portion as illustrated in FIG. 16). The steel decking panel 100 may then be overlaid on top of the domed skylight (or the domed skylight 10 may be inserted into the decking panel aperture 102), and the adhesive 106 (or other attachment means) operatively couples the steel decking panel 100 to the domed skylight 10. The flashing 144 is placed behind the pane skylight edge 32 and/or the pane skylight ends 33 of the domed skylight 10 (with or without a sealant, such as adhesive or other type of sealant, or the like) and a fastener (e.g., a rivet, bolt and nut, liquid or solid fastener, or the like) fastens the female panel edge 150, the adhesive 106, the domed skylight 10, and/or the flashing 144 together. FIG. 15 illustrates that in one embodiment the fastener 146 couples the steel decking panel 100 on the flat portion (e.g., x-y plane) of the pane skylight portion 30 of the domed skylight 10; however, it should be understood that the fastening may occur at other locations on or near the pane skylight edge 32 of the domed skylight 10, such as an upwardly extending portion of the pane skylight edge 32, as will be discussed in further detail later.

FIG. 16 illustrates that in one embodiment the fastener is a rivet; however it should be understood that in other embodiments of the invention other fasteners may be used, such as other mechanical fasteners, liquid or solid fasteners that harden to create a water tight seal, or a combination of both. In some embodiments in addition to the fastener 146 (or in lieu of the fastener), a sealant 142 (e.g., a silicon sealant, or another like seal) may be applied at the location of the decking panel aperture edge 108 of the panel 100 and a surface of the domed skylight 10 (e.g., a surface at which aperture edge 108 meets the surface of the pane skylight portion 30 of the domed skylight 10 (e.g., the pane skylight edge 32, the pane skylight ends 33, the length-wise domed edges 24, and/or the width-wise domed ends 26).

The female panel edge 150 may have the same configuration as was previously discussed with respect to the female rail edge 50 in FIG. 10 (e.g., cavity 152 created by the legs 154, 156, 158, 160, 162, and 164). However, unlike the sixth leg 64 in the female rail edge 50, the sixth leg 164 in the female panel edge 150 ends in the pane trough 34 at the panel aperture 102. In other embodiments the fifth leg 162 in the female panel edge 150 may be the end of the female panel edge 150, and thus, not extend into the pane trough 34. Despite the specific female panel edge 150 illustrated herein, it should be understood that the present invention may be utilized with any type of edge configuration used in structural steel decking.

FIG. 17 provides an enlarged view of the male panel edge assembly 170 from FIG. 15. As illustrated in FIG. 17 the male panel edge assembly 170 comprises a male panel edge 180, a sealant 172, flashing 174 (e.g., pane edge flashing), a fastener 146, and the adhesive 106. The male panel edge assembly 170 is formed in the same way as previously described with respect to the female panel assembly 140 illustrated in FIG. 16.

The male panel edge 180 may have the same configuration as was previously discussed with respect to the male panel edge 80 in FIG. 11 (e.g., a tab 182 created by legs 184, 186, 188, 190, 192, and 194). However, unlike the sixth leg 94 in the male rail edge 80, the sixth leg 194 in the male panel edge 180 end in the pane trough 34 at the panel aperture 102. In other embodiments the fifth leg 192 in the female panel edge 150 may be the end of the male panel edge 180, and thus, not extend into the pane trough 34. Despite the specific male panel edge 180 illustrated herein, it should be understood that the present invention may be utilized with any type of edge configuration for structural steel decking.

In some embodiments of the invention the domed skylight 10 may or may not have the upwardly extending portion of the pane skylight edges 32. As such, depending on the embodiment and fastening means, the fastening may occur at an upwardly extending portion of the pane skylight edges 32, at the pane trough 34 portion of the pane skylight edges 32 (e.g., flat horizontal portion), both, or another location. The fastening means may also occur along the pane skylight ends 33.

As will be discussed in further detail later the panel edge assemblies 140, 170 are operatively coupled to adjacent steel decking panels using the male and female panel edges 150, 180, while the panel ends 110 of the panel 100 may have apertures (e.g., pre-formed apertures or apertures formed during installation) or other sealing means (e.g., adhesive, sealant, or the like) through which the panel 100 is operatively coupled to the ends of adjacent steel decking panels. In some embodiments of the invention, one of the panel ends 110 (e.g., 112) has a length that is longer than the other panel end 110 (e.g., 114), in order to overlap one end over an adjacent decking panel and one end under an adjacent decking panel, or for other reasons.

Figure 18:
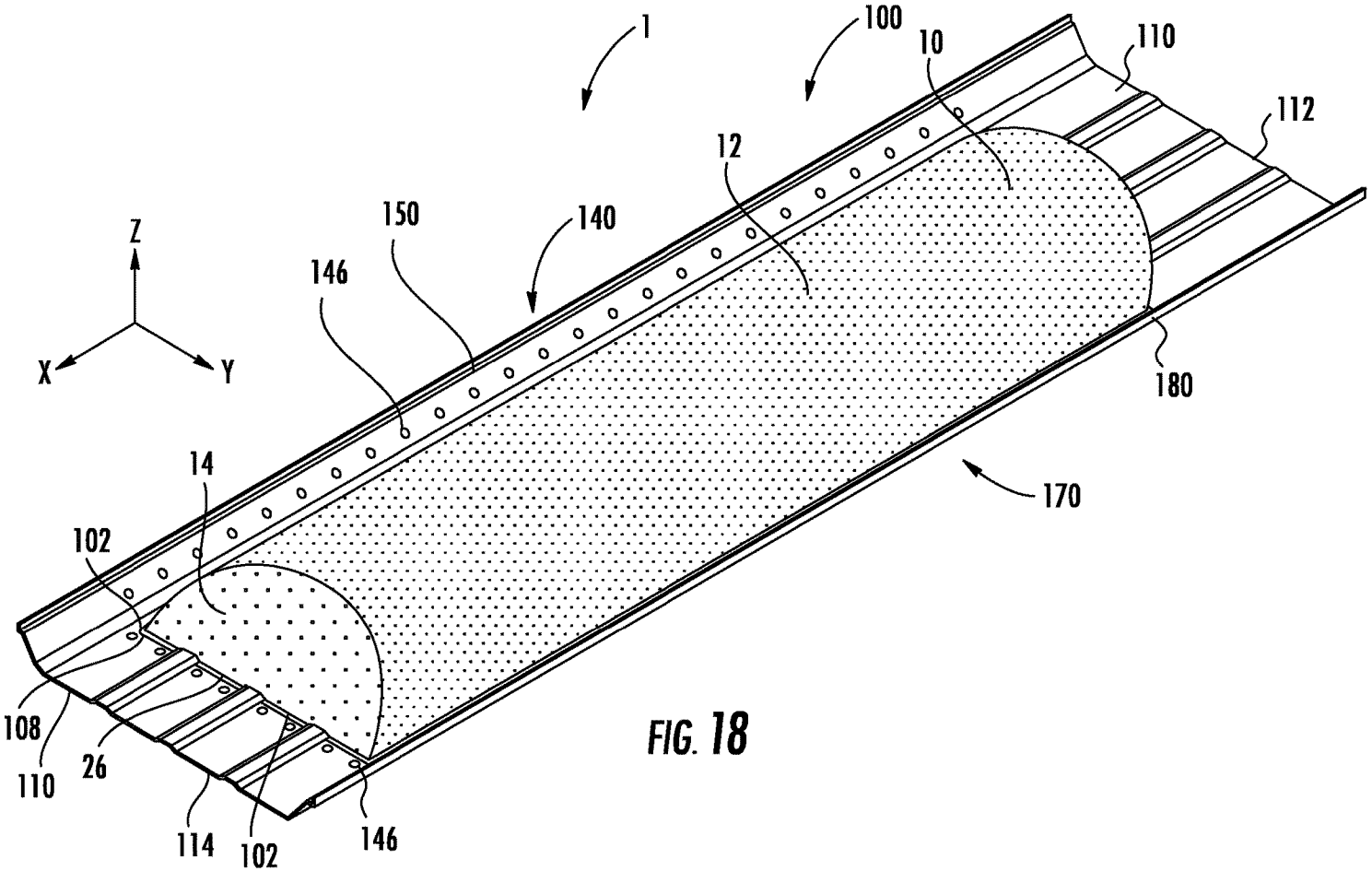
FIG. 18 illustrates a perspective view of a pre-fabricated domed skylight panel assembly with a domed skylight coupled within an aperture in a steel decking panel, in accordance with embodiments of the invention.
Figure 19:
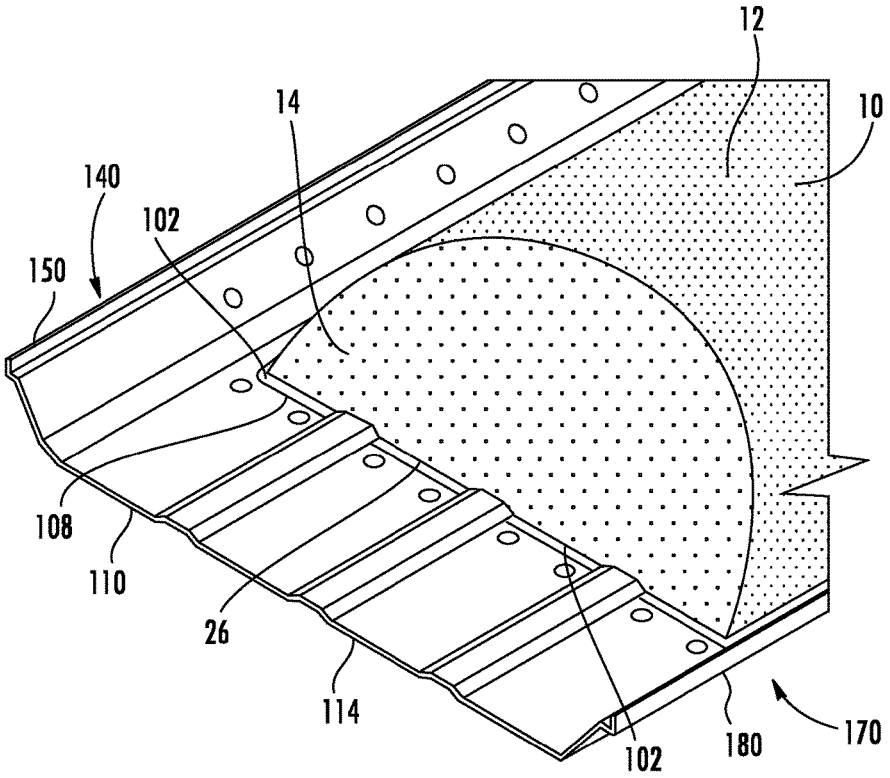
FIG. 19 illustrates a perspective enlarged view of a pre-fabricated domed skylight panel assembly of FIG. 18, in accordance with embodiments of the invention.

FIGS. 18 through 27 illustrate other embodiments of the pre-fabricated domed skylight panel assembly 1 in which the pane skylight edges 32 of the domed skylight 10 are coupled to the edge assemblies 140, 170 of the steel decking panel 100 with fasteners 142 through the upwardly extending portion of the pane skylight edges 32 and upwardly extending portion of the edge assemblies 140, 170 (e.g., the bent portions of the pane skylight edges 32 and the edge assemblies 140, 170). FIG. 18 illustrates the same domed skylight panel assembly 1 as described and illustrated with respect to FIG. 12, except that the illustrated fasteners 146 operatively couple the upwardly extending portion of the pane skylight edges 32 to the upwardly extending portion of the female panel edge assembly 140 the a male panel edge assembly 170. Moreover, FIG. 19 illustrates an enlarged view of an end of the skylight panel assembly 1 of FIG. 18.

Figure 20:
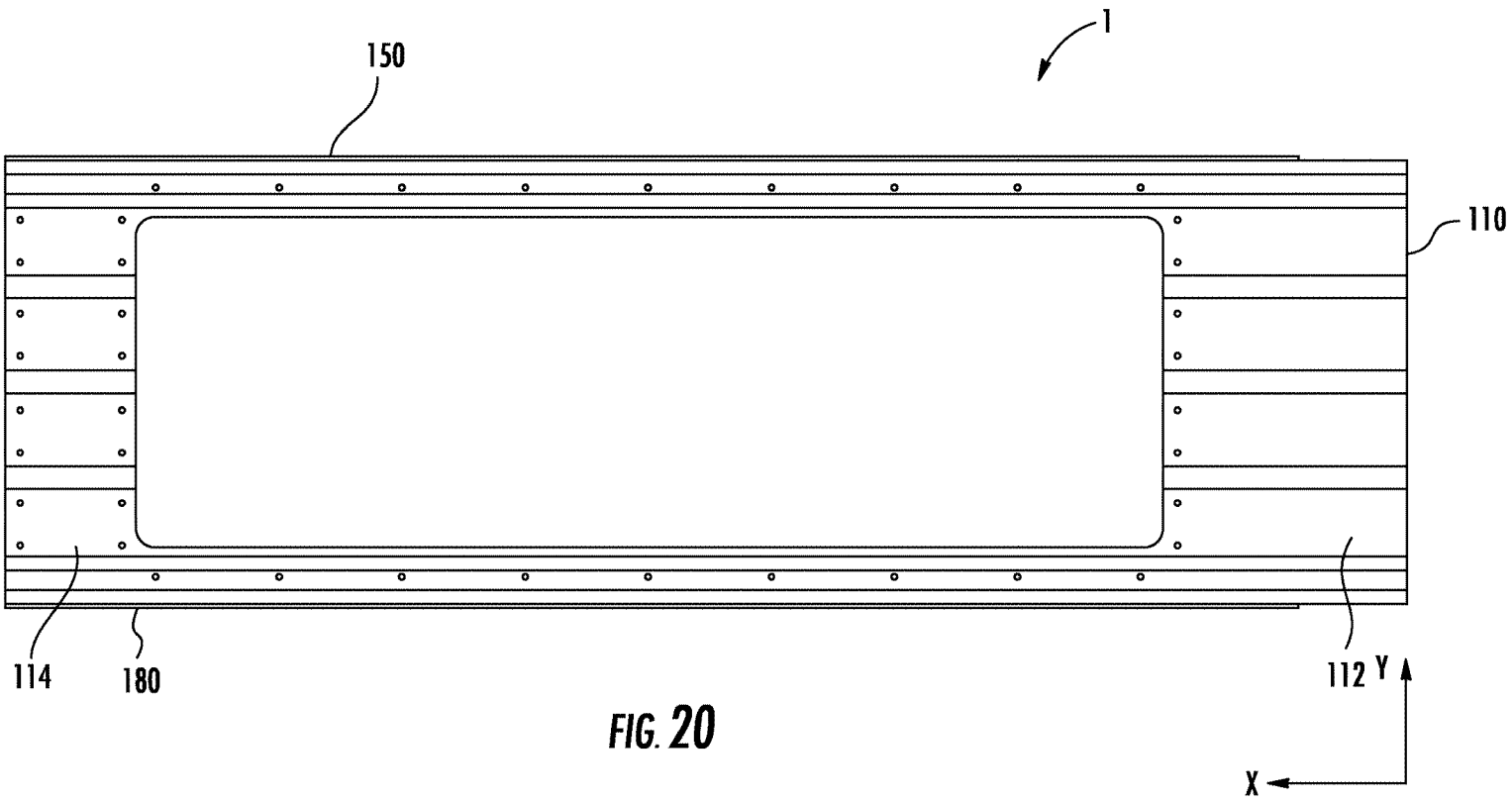
FIG. 20 illustrates a top view of the decking panel with an aperture for a pre-fabricated domed skylight panel assembly, in accordance with embodiments of the invention.
Figure 21:
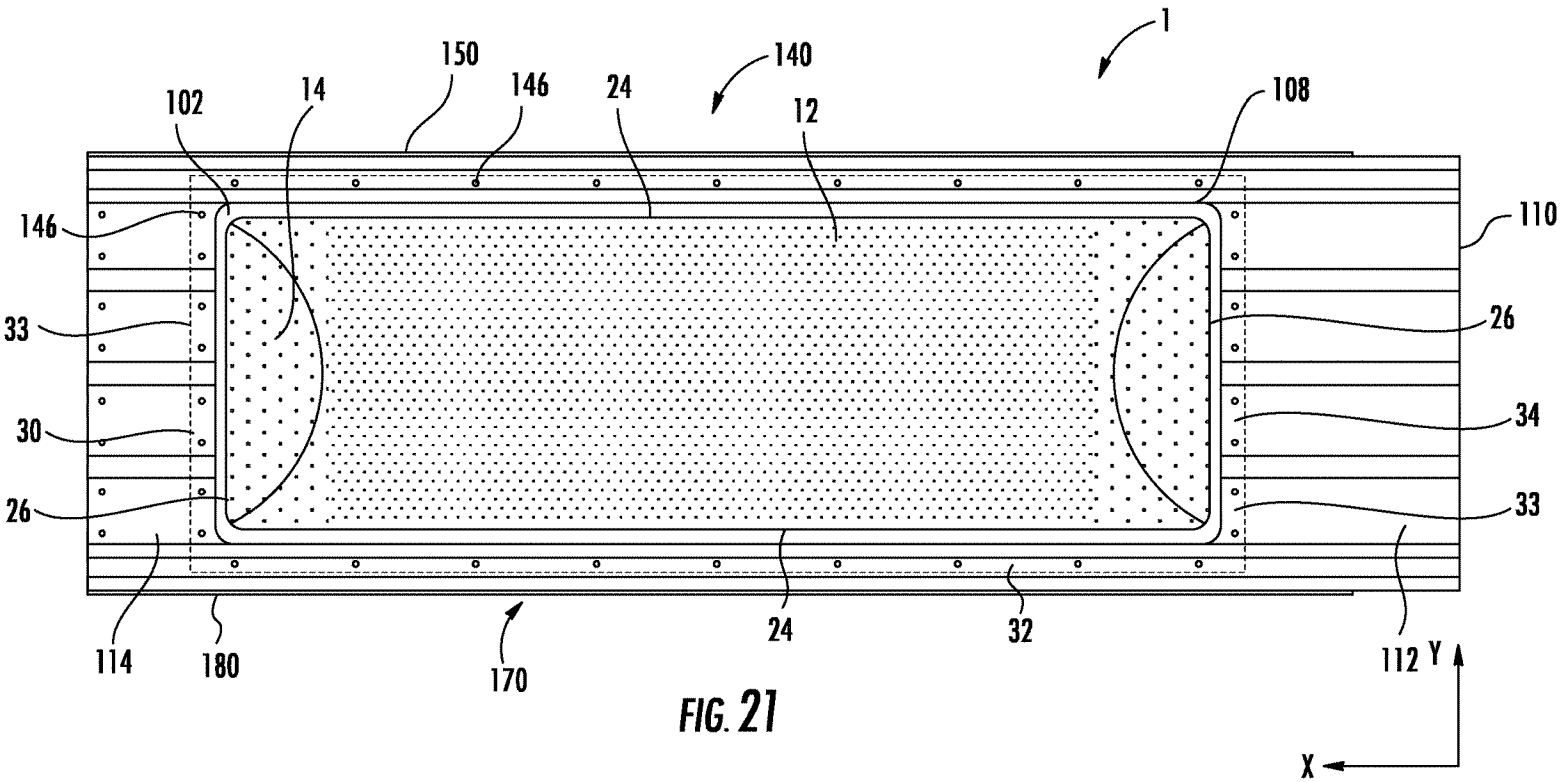
FIG. 21 illustrates a top view of a pre-fabricated domed skylight panel assembly of FIG. 18, in accordance with embodiments of the invention.
Figure 22:
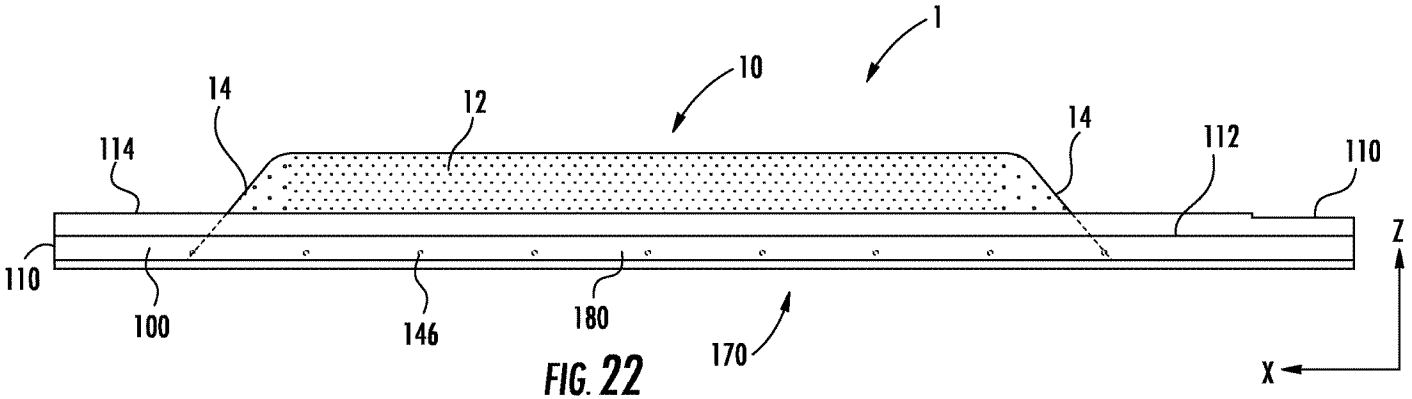
FIG. 22 illustrates a side view of the pre-fabricated domed skylight panel assembly of FIG. 18, in accordance with embodiments of the invention.

FIG. 20 illustrates a top view of the steel decking panel 100 with the decking panel aperture 102, and without the domed skylight 10 installed within the aperture 102. FIG. 21 illustrates one embodiment of the steel decking panel 100 with the decking panel aperture 102, and with the domed skylight 10 installed within the aperture 102. FIG. 21 illustrates the fasteners 146 that operatively couple the panel ends 110 of the steel decking panel 100 to the pane skylight ends 33 and the fasteners 146 that operatively couple the pane skylight edges 32 to the panel edges 104 (e.g., the female panel edge 150 and the male panel edge 180). FIG. 22 illustrates a side view of the skylight panel assembly 1 of FIG. 18. FIG. 22 illustrates the fasteners 146 used to operatively couple upwardly extending portion of the pane skylight edges 32 to the upwardly extending portion of the male panel edge assembly 170 (or the female panel edge assembly 140).

Figure 23:
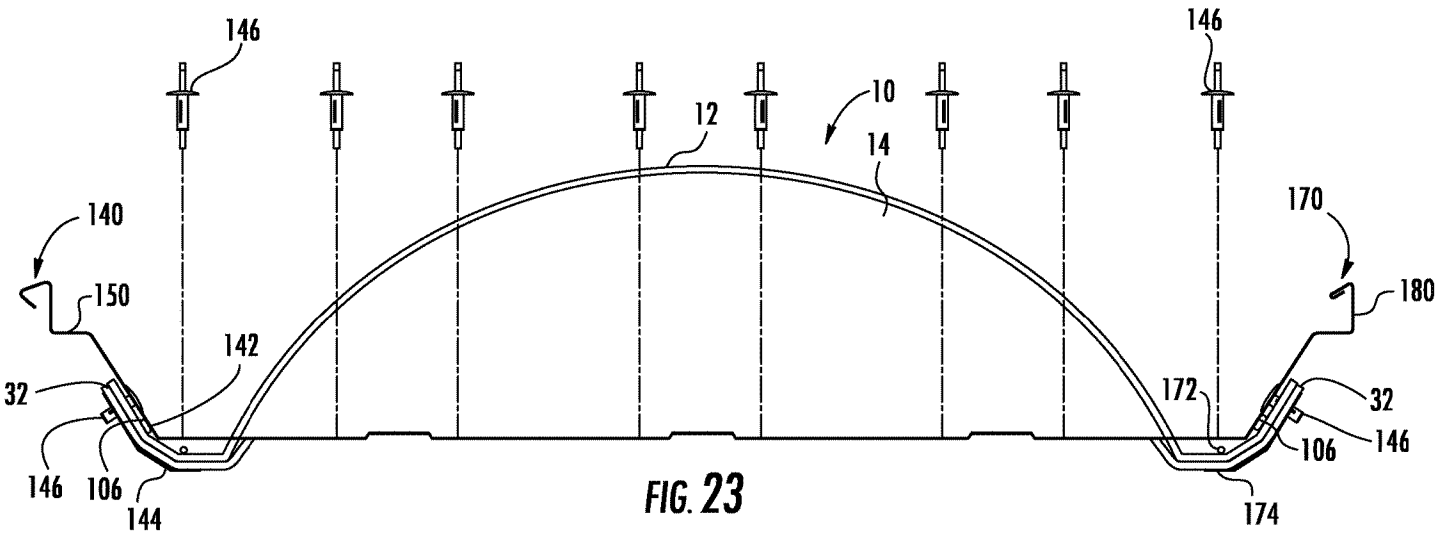
FIG. 23 illustrates a cross-sectional end view of a pre-fabricated domed skylight panel assembly of FIG. 18, in accordance with embodiments of the invention.
Figure 24:
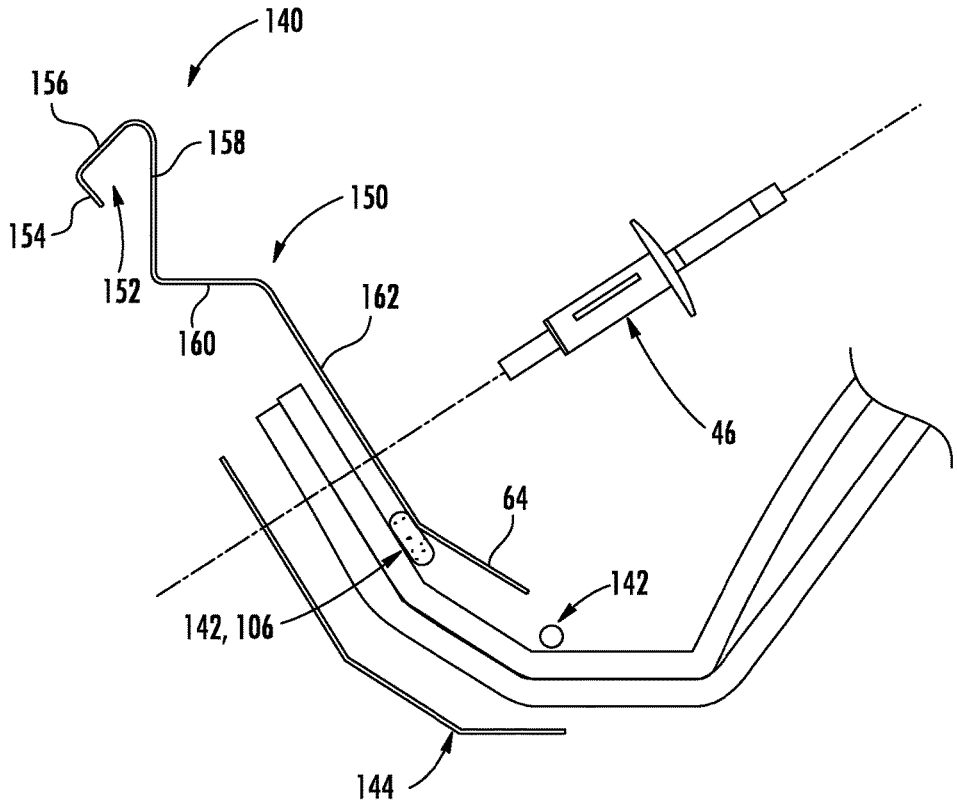
FIG. 24 illustrates an enlarged exploded view of the female edge of the cross-sectional view of the pre-fabricated domed skylight panel assembly illustrated in FIG. 23, in accordance with embodiments of the invention.

FIGS. 23 and 24 illustrate one embodiment of operatively coupling the domed skylight 10 to the steel decking panel 100 with the decking panel aperture 102 therein. As illustrated by FIG. 23, the domed skylight 10 is operatively coupled within a female panel edge assembly 140 on one edge 104 and a male panel edge assembly 170 on an opposite edge 104 of a steel decking panel 100. FIG. 24 provides an enlarged exploded view of the female panel edge assembly 140 from FIG. 22. As illustrated in FIG. 24, the female panel edge assembly 140 comprises a female panel edge 150, a sealant 142 and/or an adhesive 106, flashing 144 (e.g., pane edge flashing), and a fastener 146. As illustrated by FIG. 24 the sealant 142 and/or the adhesive 106 (or other type of attachment means) is overlaid around the entire perimeter of the domed skylight 10, including the upward angled pane skylight edges 32 (on both sides of the width of the domed skylight 10) and the pane skylight ends 33 (on both ends) of the pane skylight portion 30. In some embodiments the sealant 142 and/or the adhesive 106, as illustrated, is located on the third bent portion of the pane skylight edges 32; however, as previously discussed it may be located on one or more other portions of the pane skylight edges 32 (e.g., second bent portion, first flat portion, or the like), or combination thereof.

The steel decking panel 100 may then be overlaid on top of the domed skylight (or the domed skylight 10 may be inserted into the decking panel aperture 102), and the sealant 142 and/or adhesive 106 (or other attachment means) operatively couples the steel decking panel 100 to the domed skylight 10. In other embodiments, the sealant 142 and/or the adhesive 106 (or other types of attachment means) is overlaid on the decking panel 100 and then coupled to the domed skylight 10.

The flashing 144 is placed behind the pane skylight edge 32 and/or the pane skylight ends 33 of the domed skylight 10 (with or without a sealant or adhesive, or the like) and a fastener 146 (e.g., a rivet, bolt and nut, liquid or solid fastener, or the like) fastens the female panel edge 150, the sealant 142 and/or adhesive 106, the domed skylight 10, and/or the flashing 144 together.

FIG. 24 illustrates that in one embodiment the fastener is a rivet; however it should be understood that in other embodiments of the invention other fasteners may be used, such as other mechanical fasteners, liquid or solid fasteners that harden to create a water tight seal, or a combination of both. In some embodiments, in addition to the fastener 146 (or in lieu of the fastener), a sealant 142 (e.g., a silicon sealant, or another like seal) may be applied at the location of the decking panel aperture edge 108 of the panel 100 and a surface of the domed skylight 10 (e.g., a surface at which aperture edge 108 meets the surface of the pane skylight portion 30 of the domed skylight 10 (e.g., the pane skylight edge 32, the pane skylight ends 33, the length-wise domed edges 24, and/or the width-wise domed ends 26)

The female panel edge 150 may have the same configuration as was previously discussed with respect to the female rail edge 50 in FIG. 10 or the female panel edge in FIG. 16 (e.g., cavity 152 created by the legs 154, 156, 158, 160, 162, and 164). However, unlike the sixth leg 164 illustrated in FIG. 16, the sixth leg 164 in FIG. 24 is angled to correspond to the second bent portion of the pane skylight edge 32 and ends in the panel aperture 102. Despite the specific female panel edge 150 illustrated in FIG. 24, it should be understood that the present invention may be utilized with any type of edge configuration used in structural steel decking. It should further be understood that the male panel edge assembly 170 illustrated in FIG. 23 is similar to the male rail edge 80 in FIG. 11 or the male panel edge assembly 170 described in FIG. 17 along with the differences described with respect to the female panel edge 150 illustrated in FIG. 24.

Figure 25:
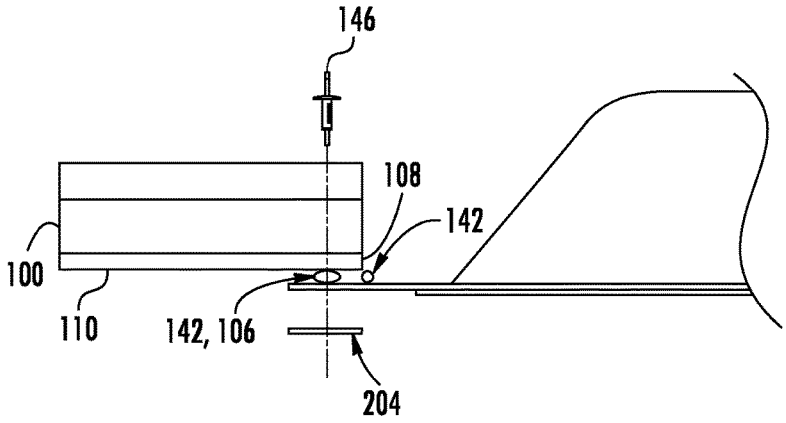
FIG. 25 illustrates an enlarged exploded cross-sectional side view of the panel end of the pre-fabricated domed skylight panel assembly illustrated in FIG. 23, in accordance with embodiments of the invention.

FIG. 25 illustrates one embodiment regarding how the pane skylight ends 33 are operatively coupled to decking panel ends 110 through an end assembly 200. As illustrated in FIG. 25, the end assemblies 200 may comprise a portion of the decking panel end 110 (e.g., trough end 202, or pan end), coupled to the pane skylight end 33, through the use of the sealant 142 and/or adhesive 106 (e.g., at one or more locations), flashing 204 (e.g., pane end flashing), and fasteners 146. The sealant 142 (or adhesive 106, or other type of attachment means) may be overlaid on the pane skylight end 33 (as previously discussed with respect to FIG. 16). The steel decking panel 100 may then be overlaid on top of the domed skylight (or the domed skylight 10 may be inserted into the decking panel aperture 102), and the sealant 146 (or adhesive 106, or other attachment means) operatively couples the steel decking panel 100 to the domed skylight 10. The flashing 204 is placed behind the pane skylight ends 33 of the domed skylight 10 (with or without a sealant or adhesive, or the like). The flashing 204 (or other flashing described herein) may be separate from the edge flashing 144, or may be integral with the edge flashing 144. A fastener (e.g., a rivet, bolt and nut, liquid or solid fastener, or the like) fastens the decking panel end 110, the sealant 142 (or adhesive 106, or other attachment means), the domed skylight 10, and/or the flashing 204 together. In some embodiments, additional sealant 142 (of the same or a different type) may be applied at the location of the decking panel aperture edge 108 of the panel 100 and a surface of the domed skylight 10 (e.g., a surface at which aperture edge 108 meets the surface of the domed skylight 10, such as the pane skylight ends 33, the pane skylight edges 32, the length-wise domed edges 24, and/or the width-wise domed ends 26). Moreover, as previously discussed, the pane skylight edge 32, the pane skylight ends 33, the portion of the decking panel end 110 (e.g., trough end 202, or pan end), and/or the flashing 204 (e.g., pane end flashing), may have apertures (e.g., pre-formed apertures or apertures formed during assembly) through which the fasteners 146 may operatively couple the components together.

Figure 26:
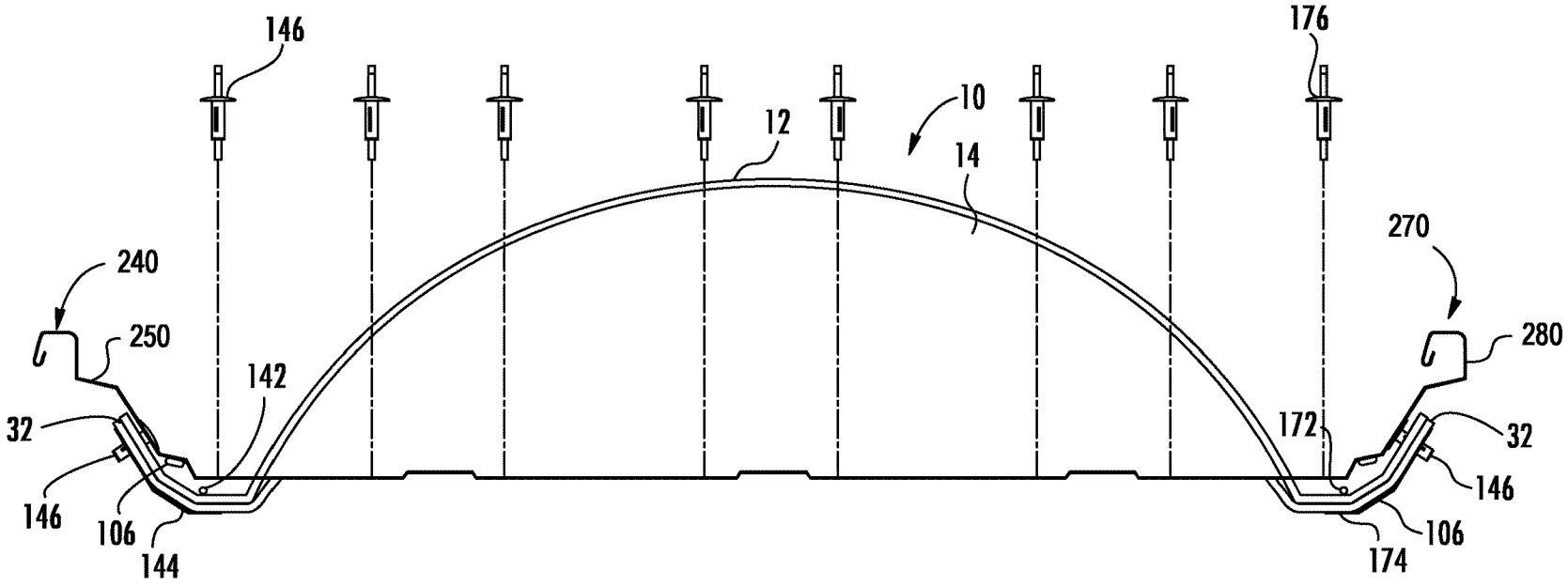
FIG. 26 illustrates a cross-sectional end view of a pre-fabricated domed skylight panel assembly, in accordance with embodiments of the invention.
Figure 27:
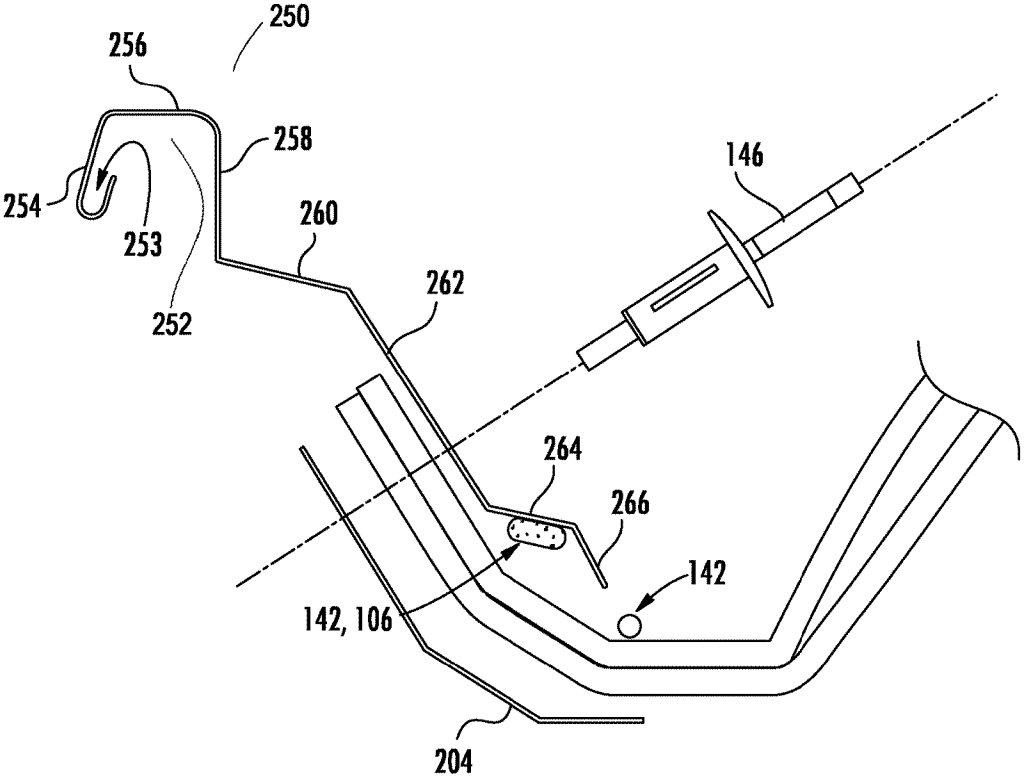
FIG. 27 illustrates an enlarged exploded view of the female edge of the cross-sectional end view of the pre-fabricated domed skylight panel assembly illustrated in FIG. 26, in accordance with embodiments of the invention.

FIGS. 26 and 27 illustrate another embodiment of operatively coupling the domed skylight 10 to the steel decking panel 100 with the decking panel aperture 102 therein. As illustrated by FIG. 26, the domed skylight 10 is operatively coupled to a female panel edge assembly 240 on one edge 104 and a male panel edge assembly 270 on an opposite edge 104 of a steel decking panel 100. FIGS. 26 and 27 illustrate edge assemblies 240, 270 that are the same as the edge assemblies 140 and 170 of FIGS. 23 and 24 (and FIGS. 15 and 16) except for the configuration of the male panel edge 250 and the female edge 280. As illustrated in FIG. 27, the female panel edge 250 may have a cavity 252 that is formed by bending one or more legs into the desired cavity 252. As such, the female panel edge 250 may have a first leg 254 with a hook 253 at the end, a second leg 256 extending substantially horizontal from the first leg 254, a third leg 258 extending in a substantially vertical orientation, a fourth leg 260 extending in a substantially horizontal orientation or as illustrated in a downward angle towards the pane skylight trough 34 of the panel 100, a fifth leg 262 extending at the same or similar angle(s) as the pane skylight edge(s) 32 (e.g., third bent portion) of the pane skylight portion 30, and a sixth leg 264 that is bent to diverge from the pane skylight edges(s) (e.g., second bent portion), and a seventh leg 266 that is bent to converge with the pane skylight edge(s) (e.g., second bent portion, or first flat portion). The seventh leg 266 may have a seventh leg end 267 that is bent at the same or similar angle to the skylight edges(s) (e.g., second bent portion or first flat portion). The sixth leg 264 and seventh leg 266 form a sealant cavity 268 above the pane skylight edges(s) (e.g., the second bent portion). Despite the specific female panel edge 250 illustrated herein, it should be understood that the present invention may be utilized within any type of seam configuration for use within structural steel decking. It should further be understood that the male edge assembly 270 illustrated in FIG. 26 is similar to the male panel edge assembly 170 described with respect to FIG. 17 and FIG. 10 along with the differences described with respect to the female panel edge 250 illustrated in FIG. 27 (e.g., legs 260-266) and having a tab 182 that fits within the hook 253 of the female panel edge 250.

It should be understood that the term skylight female edge assembly includes the female rail edge assembly 40 or the female panel assembly 140, 240, while the term skylight female edge includes the female rail edge 50 or the female panel edge 150, 250. It should be further understood that the term skylight male edge assembly includes the male rail edge assembly 70 or the male panel edge assembly 170, 270, while the term skylight male edge includes the male rail edge 80 or the male panel edge 180, 280.

As described above, the domed skylight panel assembly 1 may utilize sealant in different areas. The sealant has been described as being a mastic, adhesive, cement, bonding material, combination thereof, or the like. The domed skylight panel assembly 1 has been further described as using adhesive (e.g., in some embodiments adhesive is a sealant) to operatively couple the domed skylight 10 to the panel 100 or rail edges 50, 80. Thereafter, a different type of sealant may also be used to seal the aperture edge 108 of the aperture 102 of the panel 110, or the rail edges 50, 80, to the domed skylight 10, such as a waterproof sealant such as silicon, or the like. As such, while the term adhesive may be used for a specific type of sealant, it should be understood that other types of sealants may be utilized to secure two parts together, and provide a watertight or water resistant seal. As such, the domed skylight 10 may be coupled to the panel 100 or rails using one or more types of sealant, such as an adhesive to operatively couple them together and another type of sealant to create a watertight edge where the panel 100 or rails meet the domed skylight 10 meet. In some embodiments, a single type of sealant (e.g., adhesive or other type of sealant) may provide both the adhesion of the mating surfaces and the watertight seal. As such, it should be understood that different types of sealant may be used alone, or used in combination with one or more other types of sealants to provide additional adhesion and/or watertight or water resistant seals.

As described above, the fasteners 46, 146 operatively couple the pane skylight edges 34 to the female and male rail edges 50, 80 or the female panel and male panel edges 150, 170, 250, 270, and to the edge flashing 44, 144, as well as operatively coupling the pane skylight ends 33 to panel ends 110 and end flashing 204, or adjacent decking panels. The figures illustrate that the fasteners are located at areas where the sealant (e.g., adhesive, or the like) is placed; however, it should be understood that in some embodiments the fasteners may be located at locations other than where the sealant is located.

Figure 28:
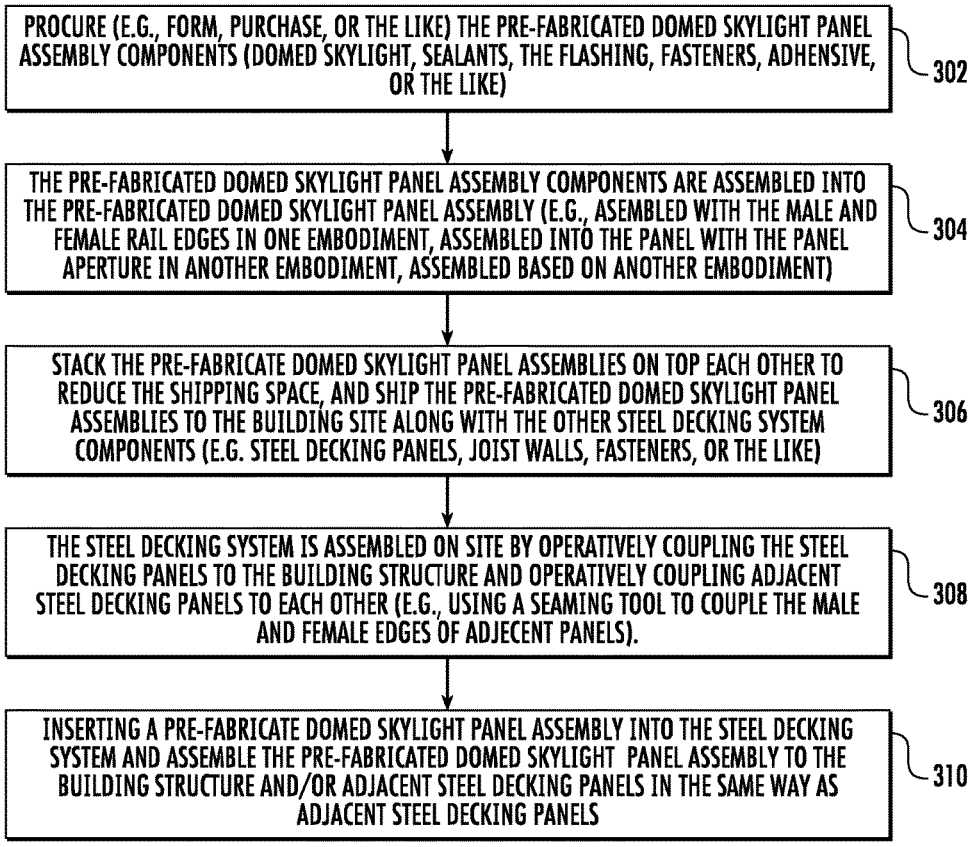
FIG. 28 illustrates a pre-fabricated domed skylight panel assembly production and installation process, in accordance with embodiments of the invention.

FIG. 28 illustrates one embodiment of a method of forming a steel decking system utilizing the pre-fabricated domed skylight panel assemblies 300. As illustrated by block 302, in one embodiment of the invention the components are procured (e.g., formed or manufactured, purchased, or the like). For example, the domed skylight 10, the sealants 42, 72, 142, 172, the flashings 44, 74, 144, 174, 204 the fasteners 46, 146, (which may be the same or different fasteners), and/or the adhesive 106 (which may be a type of sealant) are either made, purchased, or otherwise received. Moreover, either the male and female rail edges 50, 80 are procured (e.g., formed, purchased, received, or the like), or a steel decking panel 100 is procured with or without a decking panel aperture 102 (e.g., an aperture can be cut out).

As illustrated by block 304 the components are assembled into the pre-fabricated domed skylight panel assemblies 1, as previously discussed above, depending on the type of domed skylight panel assembly 1 being utilized. For example, the components are formed into the panel assembly that utilizes the rail edges 50, 80, a panel assembly that utilizes the decking panel 100 with a decking aperture 102 with the edges 150, 180, 250, 280, or another type of panel assembly. The pre-fabricated domed skylight panel assemblies 1 are manufactured in a production environment with a repeatable process, thus creating interchangeable panels that can be utilized in any steel decking system.

Figure 29:
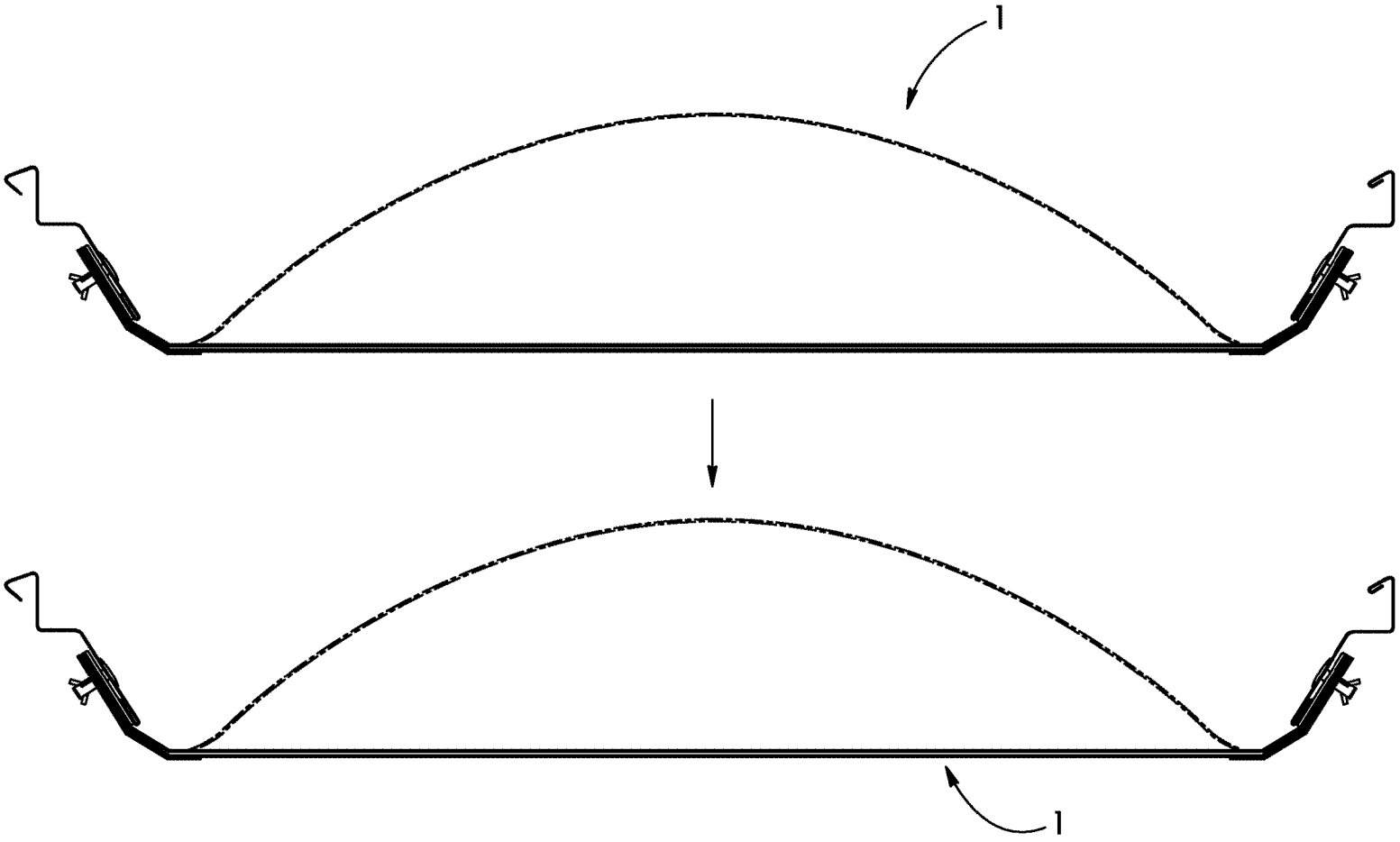
FIG. 29 illustrates a pre-fabricated domed skylight panel assembly stacked configuration, in accordance with embodiments of the invention.

Block 306 illustrates that the interchangeable pre-fabricated domed skylight panel assemblies 1 can be stacked on top of one another to reduce the size of the shipping package (e.g., volumetric space of the pre-fabricated domed skylight panel assemblies), as illustrated in FIG. 29. The pre-fabricated domed skylight panel assemblies 1 may be shipped along with steel decking panels, joists, walls, and other components in the building systems.

As illustrated by block 308 in FIG. 28, the building systems, and in particular, the steel decking systems, are assembled on site. Adjacent steel decking panels may be secured to the structural supports of the building utilizing fasteners (e.g., screws, self-drilling screws, stand-off screws, rivets, nailed fasteners, welding, liquid or solid fastening means, and/or any other like mechanical or chemical fastening means). Adjacent steel decking panels may be coupled together along the length of the panels (e.g., the male and female edges) utilizing seaming tools that bend, punch, cut, shear, and/or otherwise operatively couple adjoining male and female edges of adjacent decking panels. Moreover, the steel decking panels are coupled together along the width of the panels (e.g., the ends of the panels) using fasteners (e.g., bolts and nuts, rivets, or the like), sealant, adhesive, and/or other like coupling means.

Figure 38:
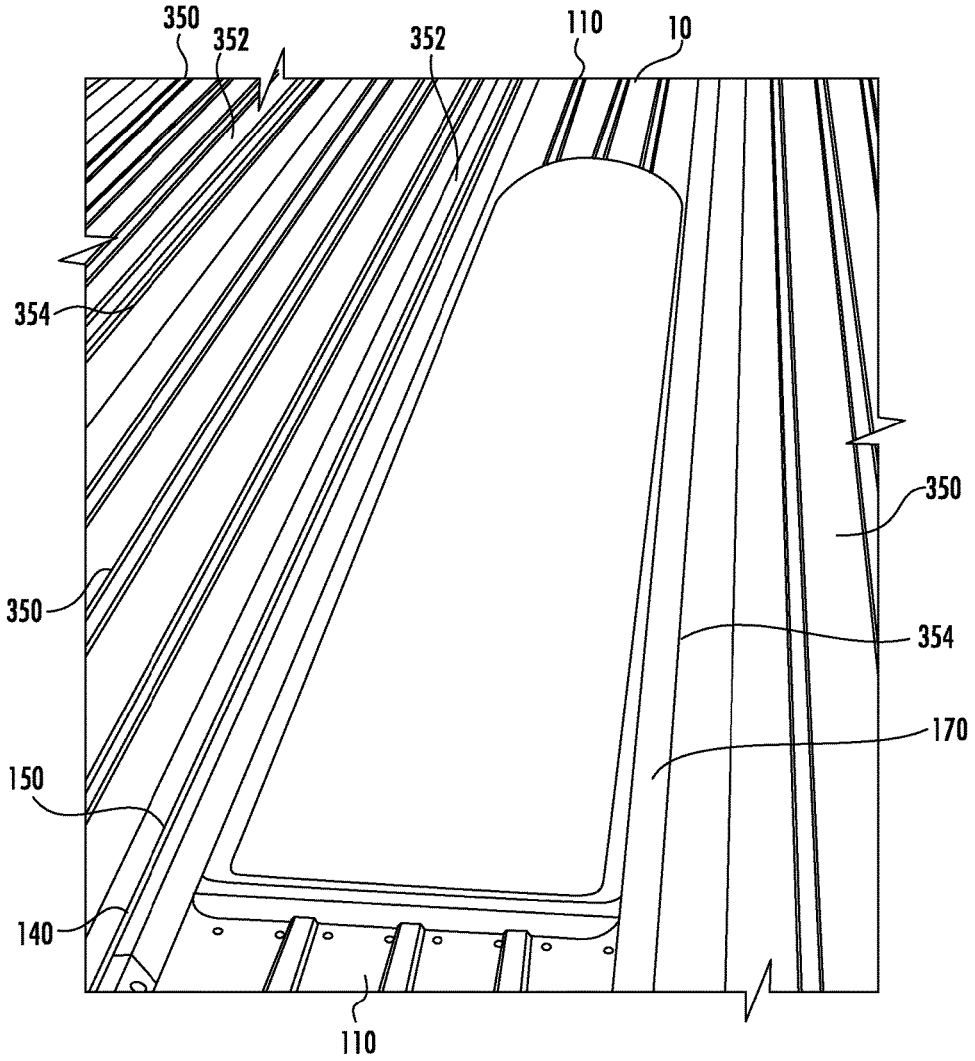
FIG. 38 illustrates one embodiment of a pre-fabricated domed skylight panel assembly operatively coupled to adjacent decking panels within a roof decking system, in accordance with embodiments of the invention.

Block 310 illustrates that either according to the building plans, or as determined on-site, in lieu a standard steel decking panel, a pre-fabricated domed skylight panel assembly 1 may be inserted into the steel decking system, and assembled in the same way using the same tools that are used to assemble the steel decking panels. For example, as illustrated in FIG. 38, the pre-fabricated domed skylight panel assembly 1 is coupled to adjacent steel decking panels 350 along the length of the panels (e.g., the female and male edges 50, 80 150, 180, 250, 280 of the edge assemblies 40, 70, 140, 170, 240, 270 of the domed skylight panel assembly) utilizing seaming tools that bend, punch, cut, shear, and/or otherwise operatively couple adjoining decking male edges 352 and decking female edges 354 of adjacent decking panels 350. For example, the female edge 50, 150, 250 of the female edge assemblies 40, 140, 240 are operatively coupled to decking male edges 352 of the adjacent steel decking panels 350, while the male edges 80, 180, 280 of the male edge assemblies 70, 170, 270 are operatively coupled to the decking female edges 354 of the adjacent steel decking panels 350, as illustrated in FIG. 38.

Moreover, the pre-fabricated domed skylight panel assembly 1 is coupled to adjacent steel decking panels along the width of the panels (e.g., the ends of the panels) by overlapping the panels and using fasteners (e.g., bolts and nuts, rivets, or the like), sealant, adhesive, and/or other like coupling means. As illustrated in FIGS. 1 through 8 in some embodiments the ends of the pre-fabricated domed skylight panel assemblies 1 are the pane skylight ends 33 which may be operatively coupled to the ends of adjacent steel decking panels by overlapping and using fasteners (e.g., bolts and nuts, rivets, or the like), sealant, adhesive, and/or other like coupling means. As illustrated in FIGS. 12, 13, 18, and 19, in some embodiments of the invention the ends of the pre-fabricated domed skylight panel assemblies 1 are the ends of the panel 100 with the panel aperture 102, which may be operatively coupled to the ends of adjacent steel decking panels in the same way that the ends of adjacent steel decking panels are coupled together, as previously described.

By utilizing the pre-fabricated domed skylight panel assemblies 1, no special assembly, no special tools, and no alternate processes are required, apart from what is already done for the steel decking panels, in order to assemble skylights into the steel decking system.

The pre-fabricated domed skylight panel assemblies 1 provide a number of advantages in steel decking systems. The domed skylight 10 may comprise ribs and fits within a single panel width and length. The ribs may provide structural support within the domed skylight 10, and thus, structural support within the domed skylight panel assemblies 1 within the steel decking systems. As such, the pre-fabricated domed skylight panel assemblies 1 can be inserted into a steel decking system without the need for extra structural supports around the skylight and/or within the steel decking system. Furthermore, because the skylight is domed and may contain ribs the domed skylight 10 has more surface area than traditional flat skylights or other domed skylights of the same size that do not have ribs.

The domed skylight may have prismatic features, such as projection elements within the surface of the domed skylight 10, which act as a prism by reflecting the light into the building. The prismatic projections may be formed on the surface of the domed skylight 10 (or any portions thereof) and extend inwardly into a surface, outwardly from a surface, or between surfaces of the domed skylight 10. The prismatic projections may be formed on the top surface (outside of the building) and/or bottom surface (e.g., inside the building), and/or be located within the top surface or bottom surface (e.g., within the surfaces of the domed skylight). Moreover, the prismatic projections may be various shapes, such as triangular, trapezoidal, circular, rectangular, square, oval, polygonal, irregular shaped, ameba shaped, or the like). The increased surface area created by the ribs and/or the prismatic features may allow for the domed skylight 10 to be secured within a single panel in the steel decking system and provide as much, or more, light than a flat skylight or domed skylight that is larger than the skylight of the present invention (e.g., spans one or more panels and one or more seams of adjacent panels).

In addition, the domed skylight of the present invention is secured to rail edges 50, 80, or within a decking panel aperture 102 with a water tight seal that is pre-assembled under factory conditions instead of onsite, thus making the water tight seal a repeatable process unlike the in-field installations. Skylights formed on site may be susceptible to installation by inexperienced installers, inclement weather, non-standard installation procedures, or the like, which all may contribute to seals in the skylights that are more susceptible to leaking than the pre-fabricated seals of the present invention that are created in a factory environment.

Moreover, the pre-fabricated domed skylight panel assemblies 1 can be stacked, as illustrated in FIG. 29, allowing shipping of multiple pre-fabricated domed skylight panel assemblies 1 at once in a reduced shipping package volume. More of the pre-fabricated domed skylights panel assemblies may be shipped at once than traditional domed skylights, which may require that multiple parts are shipped and assembled on site and may be larger than the domed skylights of the present invention. The domed skylights of the present invention may be smaller than traditional domed skylights due to the dome ribs and prismatic features in the domed skylight of the present invention that capture more light in a smaller footprint.

As previously discussed with respect to FIG. 28, the pre-fabricated domed skylight panel assemblies 1 further provide ease of assembly on site since the domed skylight panel assemblies 1 have the same male and female edges as the steel decking panels, and as such, can be assembled within a steel decking system in the same way as the steel decking panels at the locations in which skylights are desired within the steel decking system. As such, special skylight installation is not needed at the building site through installation of skylights into steel decking systems across multiple adjacent panels and seams of adjacent panels.

The present invention provides improved systems and methods for installing skylights into steel decking systems. The improvements of the pre-fabricated domed skylight panel assemblies 1 provide for reduced installation times, reduced material costs, and reduced shipping costs, thus resulting in reduced costs as well as improved lighting within the building systems.

The decking systems are described herein as being made from steel; however, in other embodiments the panels may be formed from another metal, or another material, such as composites, plastics, or the like, and the pre-fabricated domed skylight panel assembly 1 can be utilized in the same way as described herein within panels made from other types of materials. Moreover, the seams between decking panels formed from the male and female edges may be replaced by other types of edges used to create seams or otherwise join adjacent panels, and the pre-fabricated domed skylight panels assemblies 1 will work in the same ways a described herein. As such, in some embodiments the female edges describe herein may be described as a first edge, and the male edges described herein may be described as a second edge. As such, first edges adjacent second edges of adjacent panels may be coupled together in any way as know by one of ordinary skill in the art. The domed skylight 10 described herein may be coupled to the first edge and the second edges as described herein.

The decking panels and pre-fabricated domed skylight panel assemblies 1 are described and illustrated herein as having parallel or generally parallel edges, and parallel or generally parallel ends (e.g., rectangular or square shaped). However, it should be understood that in other embodiments of the invention the decking panels, the pre-fabricated domed skylight panel assemblies, the pane skylight portion 30, and/or the domed skylight portion 12 may have non-parallel edges or other types of shapes (e.g., trapezoidal, triangular, or the like).

Figure 30:
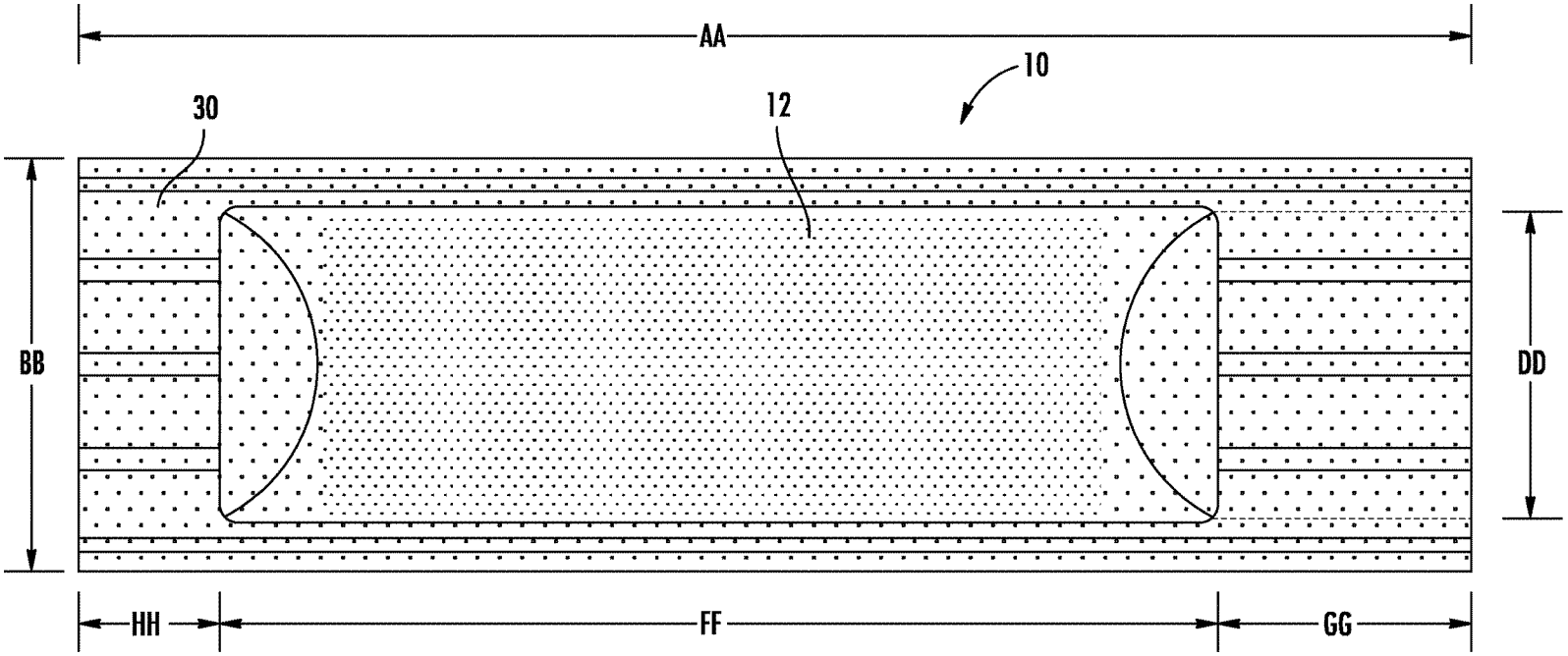
FIG. 30 illustrates a top view of the domed skylight with dimensions, in accordance with embodiments of the invention.
Figure 31:
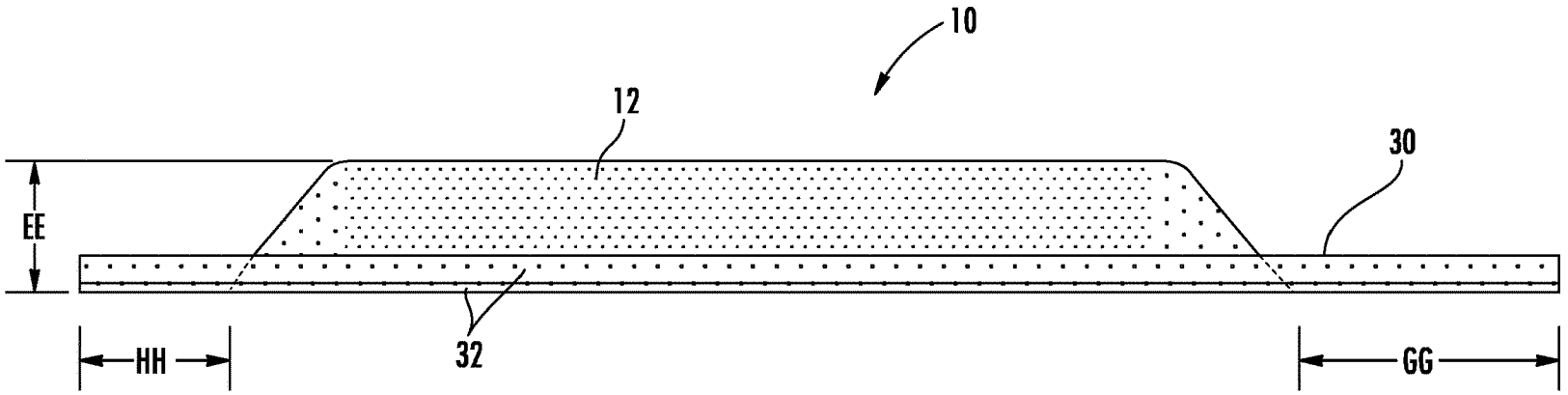
FIG. 31 illustrates a side view of the domed skylight with dimensions, in accordance with embodiments of the invention.
Figure 32:
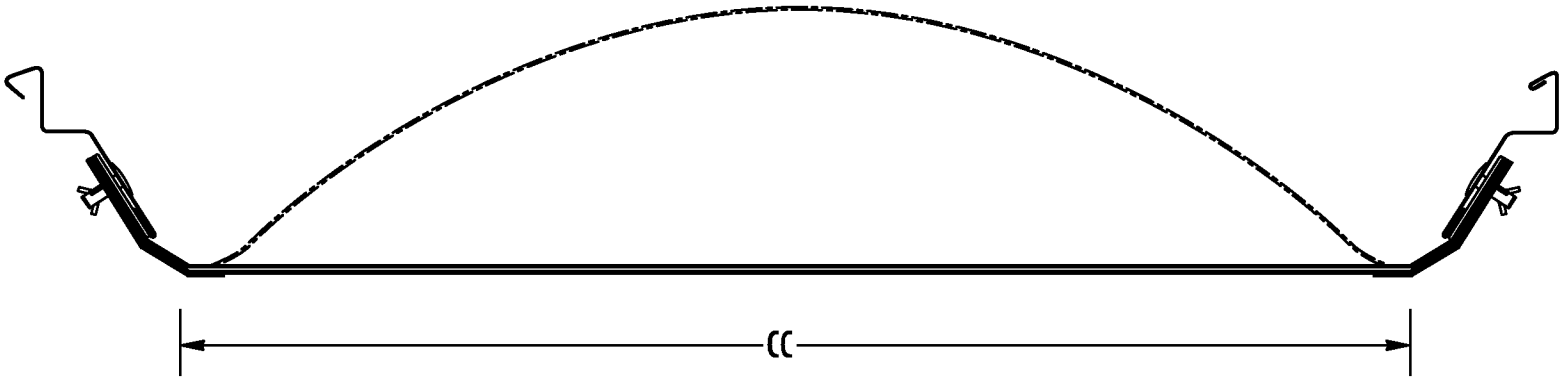
FIG. 32 illustrated an end view of the domed skylight assembly with dimensions, in accordance with embodiments of the invention.

As illustrated in FIGS. 30 through 33, while decking panels vary in dimension, a typical decking panel has an overall width of 24 inches as illustrated by dimension BB in FIG. 30, and an overall length of 126 inches (i.e., 10 ft 6 in) as illustrated by dimension AA in FIG. 30. However, decking panels may range from 12 inches to 42 inches wide and have a length of 1 foot to 150 feet. Moreover, for larger lengths, there may be two or more domed skylights 10 within a single panel 100 (or between rails 50, 80). The trough 34 region of the pane skylight portion 30 between the male and female edges 50, 80 may have a dimension of approximately 19 to 22 inches (e.g., $20\frac{7}{16}^{th}$ inches), as illustrated by dimension CC in FIG. 32. The length of the pane skylight portion 30 may be same length as the decking panel 100 itself, such as approximately 123 inches to 126 inches (e.g., when the domed skylight 10 is connected to the male and female rail assemblies 40, 70), or it may be a length that is shorter than the length of the decking panel 100. The length of the pane skylight portion 30 when the domed skylight is inserted into an aperture 102 of a decking panel 100 may be between 104 to 106 inches or range from 90 to 120 inches. Depending on the size of the decking panels it should be understood that the width and length of the pane skylight portion 30 can be scaled to correspond with the different sized decking panels described above.

The domed skylight portion 12 is dimensioned for inclusion within an aperture 102 in a decking panel 100 or otherwise dimensioned as desired based on the width and length of the pane skylight portion 30. As an example, with respect to the size of the decking panel and pane skylight portion 30 described above, the domed portion 12 may have a width of 14 to 19 inches (e.g., $17\frac{7}{16}^{th}$ inches), as illustrated by dimension DD in FIG. 30, and a height of 3 to 7 inches (e.g., 4½ inches, 5½ inches, or the like), as illustrated by dimension EE in FIG. 31.

The domed portion 12 may have a length of 100 inches to 112 inches (e.g., 106 inches) as illustrated by dimension FF in FIG. 30. The domed portion may be centered within the decking panel 100 or pane skylight portion 30, or may be offset either within the decking panel 100 or pane skylight portion 30 such that one side of the decking panel ends 110 (e.g., 112) or pane skylight ends 33 (e.g., 35) may be 11 to 15 inches long (e.g., 13 inches) as illustrated by dimension GG in FIGS. 30 and 31, while the opposite decking panel end 110 (e.g., 114) or pane skylight end 33 (e.g., 37) may be 5 to 9 inches long (e.g., 7 inches) as illustrated by dimension HH in FIGS. 30 and 31. Depending on the size of the decking panels it should be understood that the width, length, height, and/or offset of the domed portion 12 can be scaled to correspond with different sized decking panels described above.

Figure 34:
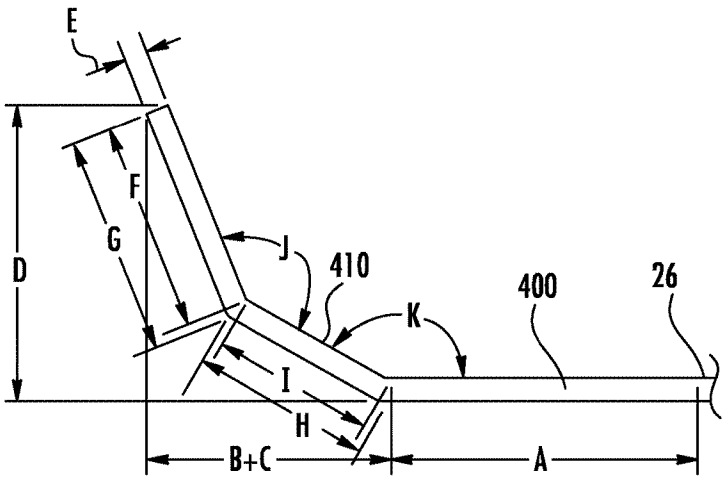
FIG. 34 illustrates an end view of the domed skylight panel edge with additional dimensions, in accordance with embodiments of the invention.
Figure 33:
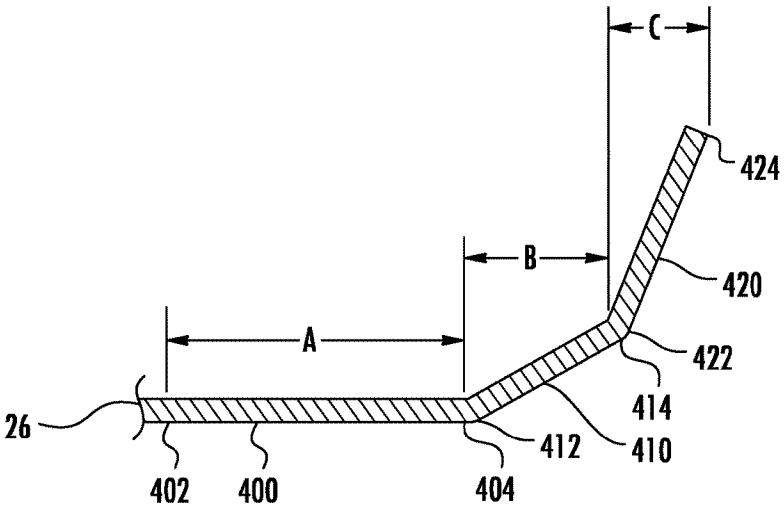
FIG. 33 illustrates an end view of the domed skylight panel edge with dimensions, in accordance with embodiments of the invention.

The pane skylight edges 32 (e.g., the edges that are coupled within the edge assemblies 40, 70, 140, 170, 240, 270) may have various shapes and dimensions according to different embodiments of how the male and female edges are operatively coupled to adjacent decking panels. FIGS. 33 and 34 illustrate one embodiment of the pane skylight edges 32. The pane skylight edges 32 may have a first portion 400 that has a first end that extends from the domed edges 26 in a horizontal orientation in a range of 1 inch to 3 inches (e.g., 1.8 to 2.0 inches, or 1.889 inches or 1.939 inches) as illustrated by dimension A in FIGS. 33 and 34.

Additionally, the pane skylight edge 32 may have a second portion 410 that extends in the upward direction at an angle of 120 to 170 degrees (e.g., 145 to 150 degrees, or 148 degrees, or 150 degrees) as illustrated by dimension K in FIG. 33. The second portion 410 may have a first end 412 that extends from the second end 404 of the first portion 400 to a second end 414 of the second portion 410, which may be located 0.25 to 1.5 inches (e.g., 0.6 to 1 inches, or 0.748 or 0.910 inches) outwardly in a horizontal direction from the second end 404 of the first portion 400, as illustrated by dimension B in FIG. 33. Additionally, the second portion 410 may have an upper surface length of 0.7 to 1.2 inches (e.g., 0.8 to 1.1 inches, or 0.881 inches, or 1.05 inches), as illustrated by dimension I, and a lower surface length of 0.8 to 1.3 inches (e.g., 0.9 to 1.2 inches, or 0.981 inches, or 1.152 inches), as illustrated by dimension H in FIG. 34.

The pane skylight edge 32 may have a third portion 420 that extends in the upward direction from the second portion 410 at an angle of 120 to 170 degrees (e.g., 135 to 155, or 142 degrees, or 152 degrees), as illustrated by dimension J in FIG. 34. The third portion 420 may have a first end 422 that extends from the second end 414 of the second portion 410 to a second end 424 of the third portion 420 that is located 0.25 to 1.5 inches (e.g., 0.5 to 0.8, or 0.688 inches, or 0.668 inches) outwardly in a horizontal direction from the second end 414 of second portion 410, as illustrated by dimension C in FIG. 33. Additionally, the third portion 420 may have an upper surface length of 1.2 to 1.6 inches (e.g., 1.3 to 1.5 inches, or 1.375 inches) as illustrated by dimension F, and a lower surface length of 1.3 to 1.7 inches (e.g., 1.4 to 1.5 inches, or 1.436 inches) as illustrated by dimension G in FIG. 34. The second end 424 of the third portion 420 may extend vertically above the horizontal first portion 400 a distance of 1 to 3 inches (e.g., 1.5 to 2.5 inches, or 1.965 inches), as illustrated by dimension D in FIG. 34. Moreover, the thickness of the panel may be 0.1 to 0.8 inches (e.g., 0.125 to 0.4 inches, or 0.165 inches), as illustrated by dimension E in FIG. 34.

Figure 35:
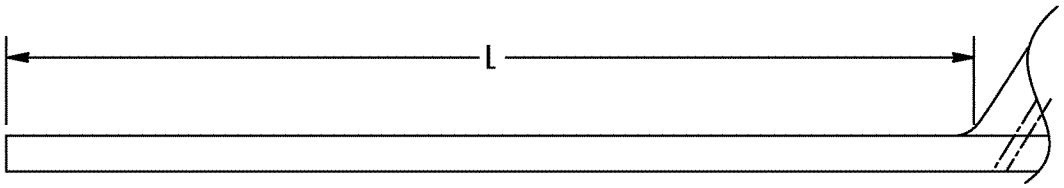
FIG. 35 illustrates an end view of the domed skylight panel edge when the edges are flat, in accordance with embodiments of the invention.

FIG. 35 illustrates another embodiment of the invention in which the pane skylight edge 32 is a horizontal flat edge that is utilized along with a panel 100 with an aperture 102 as previously discussed. In one embodiment, the length of the pane skylight edge 32 may be 2 to 6 inches (e.g., 3.5 to 5 inches, or 4.34 or 4.4 inches), as illustrated by dimension L in FIG. 35.

Figure 37:
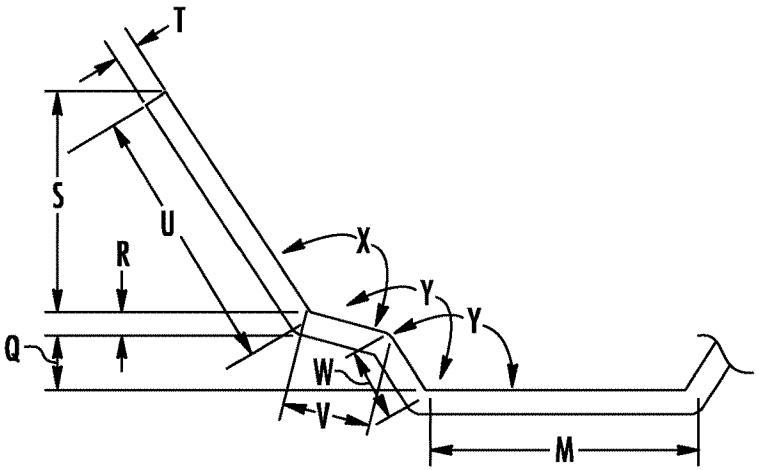
FIG. 37 illustrates an end view of the domed skylight panel edge with additional dimensions, in accordance with embodiments of the invention.
Figure 36:
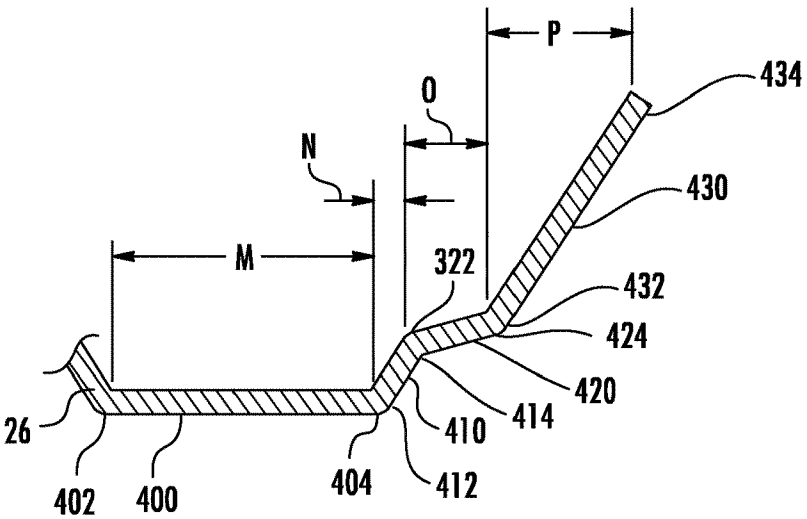
FIG. 36 illustrates an end view of the domed skylight panel edge with dimensions, in accordance with embodiments of the invention.

FIGS. 36 and 37 illustrate another embodiment of the pane skylight edges 32. The pane skylight edges 32 may have a first portion 400 that has a first end that extends from the domed edges 26 in a horizontal orientation in a range of 1 inch to 3 inches (e.g., 1.5 to 2.0 inches, or 1.705 inches) as illustrated by dimension M in FIGS. 33 and 34.

Additionally, the pane skylight edge 32 may have a second portion 410 that extends in the upward direction at an angle of 100 to 140 degrees (e.g., 115 to 125 degrees, or 120 degrees) as illustrated by dimension Z in FIG. 37. The second portion 410 may have a first end 412 that extends from the second end 404 of the first portion 400 to a second end 414 of the second portion 410, which may be located 0.1 to 0.35 inches (e.g., 0.2 to 0.3 inches, or 0.222 inches) outwardly in a horizontal direction from the second end 404 of the first portion 400, as illustrated by dimension N in FIG. 36. Additionally, the second portion 410 may have an upper surface length of 0.2 to 0.7 inches (e.g., 0.4 to 0.5 inches, or 0.448 inches), as illustrated by dimension W in FIG. 37.

The pane skylight edge 32 may have a third portion 420 that extends in the downward direction from the second portion 410 at an angle of 110 to 160 degrees (e.g., 125 to 140, or 133 degrees), as illustrated by dimension Y in FIG. 37. The third portion 420 may have a first end 422 that extends from the second end 414 of the second portion 410 to a second end 424 of the third portion 420 that is located 0.3 to 0.9 inches (e.g., 0.45 to 0.6, or 0.536 inches) outwardly in a horizontal direction from the second end 414 of second portion 410, as illustrated by dimension O in FIG. 35. Additionally, the third portion 420 may have an upper surface length of 0.3 to 0.8 inches (e.g., 0.5 to 0.6 inches, or 0.551 inches) as illustrated by dimension V in FIG. 36. The bottom surface of the second end 424 of the third portion 420 may extend vertically above the top surface of the horizontal first portion 400 a distance of 1 to 0.2 to 0.5 inches (e.g., 0.35 to 0.45 inches, or 0.389 inches), as illustrated by dimension Q in FIG. 37.

The pane skylight edge 32 may have a forth portion 430 that extends in the upward direction from the third portion 420 at an angle of 120 to 170 degrees (e.g., 130 to 145, or 137 degrees), as illustrated by dimension X in FIG. 37. The fourth portion 430 may have a first end 432 that extends from the second end 424 of the third portion 420 to a second end 434 of the third portion 430 that is located 0.05 to 1.5 inches (e.g., 0.8 to 1.1, or 0.942 inches) outwardly in a horizontal direction form the second end 424 of the third portion 420, as illustrated by dimension P in FIG. 34. Additionally, the forth portion 430 may have an upper surface length of 1 to 2.5 inches (e.g., 1.6 to 1.9 inches, or 1.729 inches) as illustrated by dimension U in FIG. 36. The top surface of the first end 432 of the forth portion 430 may extend vertically above the bottom portion of the second end 424 of the third portion 420 a distance of 0.05 to 0.25 inches (e.g., 0.1 to 0.15 inches, or 0.13 inches) as illustrated by dimension R in FIG. 37. Moreover, the second end 434 of the forth portion 430 may extend vertically above the first end 432 of the forth portion a distance of 1 to 2 inches (e.g., 1.35 to 1.55 inches, or 1.45 inches) as illustrated by dimension S in FIG. 37. Moreover, the thickness of the panel may be 0.1 to 0.8 inches (e.g., 0.125 to 0.4 inches, or 0.165 inches), as illustrated by dimension T in FIG. 37.

In other embodiments, as previously illustrated in FIGS. 15 through 17, the pane skylight edges 32 may have a first portion that has a first end that extends from the domed edges 26 in a horizontal orientation as illustrated and described in FIGS. 33 through 37. Additionally, the pane skylight edge 32 may have a single second portion that extends in the upward direction at any angle, such as the angles described with respect to any of the bends in FIGS. 33 through 37. Moreover, the second portion may be sized as any portion or combination of portions described with respect to FIGS. 33 through 37.

It should be understood that all of the ranges described herein are just one example of the dimensions of the pre-fabricated domed skylight panel assembly 1, and it should be understood that the actual dimensions may fall within, fall outside, or overlap the stated dimension ranges and values. Moreover, the values and ranges described herein may be actual values or approximate values. It should be understood that the stated ranges and values may be scaled up or down for the different sizes of decking panels.

Specific embodiments of the invention are described herein. Many modifications and other embodiments of the invention set forth herein will come to mind to one skilled in the art to which the invention pertains, having the benefit of the teachings presented in the foregoing descriptions and the associated drawings. Therefore, it is to be understood that the invention is not to be limited to the specific embodiments disclosed and that modifications and other embodiments and combinations of embodiments are intended to be included within the scope of the appended claims. Although specific terms are employed herein, they are used in a generic and descriptive sense only and not for purposes of limitation.

What is claimed is:

1. A pre-fabricated domed skylight panel assembly extending in an x-y plane, the pre-fabricated domed skylight panel assembly comprising:

a domed skylight, comprising at least a domed skylight portion and a pane skylight portion, the pane skylight portion comprising first and second pane skylight edges and first and second pane skylight ends;

a male edge operatively coupled to a top surface of the first pane skylight edge of the domed skylight;

a female edge operatively coupled to a top surface of the second pane skylight edge of the domed skylight, wherein at least a portion of the male edge and at least a portion of the female edge extend upwardly away from the x-y plane;

one or more flashings operatively coupled to a bottom surface of the first pane skylight edge and a bottom surface of the second pane skylight edge, wherein at least a portion of the one or more flashings extend upwardly away from the x-y plane;

sealant operatively coupled to the first pane skylight edge and the second pane skylight edge of the domed skylight; and fasteners operatively coupling the domed skylight between the male edge and the one or more flashings, and between the female edge and the one or more flashings;

wherein the first pane skylight edge is located between the male edge and the one or more flashings;

wherein the second pane skylight edge is located between the female edge and the one or more flashings;

wherein the fasteners extend through the male edge, the first pane skylight edge, and the one or more flashings and through the female edge, the second pane skylight edge, and the one or more flashings; and wherein the pre-fabricated domed skylight panel assembly is configured for operative coupling with adjacent male and female edges on adjacent decking panels.

2. The pre-fabricated domed skylight panel assembly of claim 1, wherein the male edge is a male rail edge and the female edge is a female rail edge.

3. The pre-fabricated domed skylight panel assembly of claim 1, wherein at least a portion of the first pane skylight edge and at least a portion of the second pane skylight edge of the domed skylight extends upwardly away from the x-y plane.

4. The pre-fabricated domed skylight panel assembly of claim 1, wherein the male edge and the female edge are formed from a panel with a panel aperture configured for receiving the domed skylight.

5. The pre-fabricated domed skylight panel assembly of claim 1, wherein the domed skylight has prismatic elements in at least a portion of the domed skylight.

6. The pre-fabricated domed skylight panel assembly of claim 1, wherein the fasteners operatively couple the domed skylight to the male edge and the flashing, and to the female edge and the flashing at a trough portion of the pane skylight edges.

7. The pre-fabricated domed skylight panel assembly of claim 3, wherein the fasteners operatively couple the domed skylight to the male edge and the one or more flashings, and to the female edge and the one or more flashings at the pane skylight edges extending upwardly from the x-y plane.

8. The pre-fabricated domed skylight panel assembly of claim 4, wherein the pane skylight portion comprises two pane skylight ends extending from the domed skylight portion to a length that is shorter than a length of the panel.

9. The pre-fabricated domed skylight panel assembly of claim 1, wherein the domed skylight portion of the domed skylight is offset within the pre-fabricated domed skylight panel assembly such that a first length of one end of the pre-fabricated domed skylight panel assembly is longer than a second length of another end of the pre-fabricated domed skylight panel assembly to facilitate an overlapping coupling with adjacent decking panels in a decking panel system.

10. The pre-fabricated domed skylight panel assembly of claim 1, wherein the pre-fabricated domed skylight panel assembly is configured for stacking with other pre-fabricated domed skylight panel assemblies.

11. The pre-fabricated domed skylight panel assembly of claim 1, wherein the pre-fabricated domed skylight panel assembly is the same width and length as decking panels within a decking system, and wherein the pre-fabricated domed skylight panel assembly is substituted for a decking panel in the decking system.

12. The pre-fabricated domed skylight panel assembly of claim 1, wherein the pre-fabricated domed skylight panel assembly is coupled to adjacent decking panels within a decking system in the same way as the decking panels within the decking system are coupled to other decking panels.

13. A roof decking system extending in an x-y plane, the roof decking system comprising:

a plurality of roof decking panels each comprising a decking male edge and a decking female edge;

at least one pre-fabricated domed skylight panel assembly, comprising:

a domed skylight, comprising at least a domed skylight portion and a pane skylight portion, the pane skylight portion comprising first and second pane skylight edges and first and second pane skylight ends;

a male edge operatively coupled to a top surface of the first pane skylight edge of the domed skylight;

a female edge operatively coupled to a top surface of the second pane skylight edge of the domed skylight, wherein at least a portion of the male edge and at least a portion of the female edge extend upwardly away from the x-y plane;

one or more flashings operatively coupled to a bottom surface of the first pane skylight edge and a bottom surface of the second pane skylight edge, wherein at least a portion of the one or more flashings extend upwardly away from the x-y plane;

sealant operatively coupled to the first pane skylight edge and the second pane skylight edge of the domed skylight; and fasteners operatively coupling the domed skylight between the male edge and the one or more flashings, and between the female edge and the one or more flashings;

wherein the first pane skylight edge is located between the male edge and the one or more flashings;

wherein the second pane skylight edge is located between the female edge and the one or more flashings;

wherein the fasteners extend through the male edge, the first pane skylight edge, and the one or more flashings and through the female edge, the second pane skylight edge, and the one or more flashings; and wherein the male edge and the female edge of the pre-fabricated domed skylight panel assembly are configured for operative coupling with the decking male edge and the decking female edge of adjacent decking panels from the plurality of roof decking panels.

14. The roof decking system of claim 13, wherein the male edge is a male rail edge and the female edge is a female rail edge or wherein the male edge and the female edge are formed from a panel with a panel aperture configured for receiving the domed skylight.

15. The roof decking system of claim 13, wherein the fasteners operatively couple the domed skylight to the male edge and the one or more flashings, and to the female edge and the one or more flashings at a trough portion of the domed skylight or at the pane skylight edges extending upwardly from the x-y plane.

16. The pre-fabricated domed skylight panel assembly of claim 13, wherein the domed skylight has prismatic elements, and wherein the prismatic elements comprise projections that extend outwardly from, inwardly into, or are located within the surfaces of the domed skylight, and wherein the prismatic elements act as a prism by capturing, directing, or reflecting light.

17. A pre-fabricated domed skylight panel assembly extending in an x-y plane, the pre-fabricated domed skylight panel assembly comprising:

a domed skylight, comprising at least a domed skylight portion and a pane skylight portion, the pane skylight portion comprising first and second pane skylight edges and first and second pane skylight ends, and wherein at least a portion of the first pane skylight edge and the second pane skylight edge extend upwardly from the x-y plane and outwardly from the domed skylight portion or the pane skylight portion;

a male edge operatively coupled to a top surface of the first pane skylight edge of the domed skylight;

a female edge operatively coupled to a top surface of the second pane skylight edge of the domed skylight, wherein at least a portion of the male edge and at least a portion of the female edge extend upwardly from the x-y plane and outwardly from the domed skylight;

one or more flashings operatively coupled to a bottom surface of the first pane skylight edge and a bottom surface of the second pane skylight edge, wherein at least a portion of the one or more flashings extend upwardly from the x-y plane and outwardly from the domed skylight;

sealant operatively coupled to the first pane skylight edge and the second pane skylight edge of the domed skylight; and fasteners operatively coupling the domed skylight to the male edge and the one or more flashings, and to the female edge and the one or more flashings;

wherein the first pane skylight edge is located between the male edge and the one or more flashings;

wherein the second pane skylight edge is located between the female edge and the one or more flashings;

wherein the fasteners extend through the male edge, the first pane skylight edge, and the one or more flashings and through the female edge, the second pane skylight edge, and the one or more flashings; and wherein the pre-fabricated domed skylight panel assembly is configured for operative coupling with adjacent male and female edges on adjacent decking panels.

18. The roof decking system of claim 17, wherein the domed skylight comprises prismatic features, and wherein the sealant allows for the coupling of the male edge and the female edge to the one or more flashings with at least the portion of the domed skylight having the prismatic features.

* * * * *